US010092992B2

(12) United States Patent
Yasuda et al.

(10) Patent No.: US 10,092,992 B2
(45) Date of Patent: Oct. 9, 2018

(54) POLISHING APPARATUS, POLISHING HEAD, AND RETAINER RING

(71) Applicant: EBARA CORPORATION, Tokyo (JP)

(72) Inventors: Hozumi Yasuda, Tokyo (JP); Makoto Fukushima, Tokyo (JP); Osamu Nabeya, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 41 days.

(21) Appl. No.: 15/163,571

(22) Filed: May 24, 2016

(65) Prior Publication Data

US 2016/0368115 A1 Dec. 22, 2016

(30) Foreign Application Priority Data

May 25, 2015 (JP) ..... 2015-105793
Jan. 18, 2016 (JP) ..... 2016-007265
May 12, 2016 (JP) ..... 2016-096466

(51) Int. Cl.
*B24B 37/32* (2012.01)
*B24B 37/20* (2012.01)

(52) U.S. Cl.
CPC ..... *B24B 37/32* (2013.01); *B24B 37/20* (2013.01)

(58) Field of Classification Search
CPC ..... B24B 37/32; B24B 37/30
USPC ..... 451/287, 288, 289, 290, 398, 388
See application file for complete search history.

(56) References Cited

U.S. PATENT DOCUMENTS 6,354,927 B1 * 3/2002 Natalicio ..... B24B 37/30 451/285
6,840,845 B2 * 1/2005 Numoto ..... B24B 37/30 451/285
7,622,016 B2 11/2009 Lee
7,819,723 B2 * 10/2010 Nakamura ..... B24B 37/32 451/288
2003/0070757 A1 * 4/2003 DeMeyer ..... B24B 37/32 156/345.12

FOREIGN PATENT DOCUMENTS

JP 2003-124169 A 4/2003
JP 2008-229790 A 10/2008
JP 2009-190101 A 8/2009
KR 10-2005-0067148 A 6/2005
KR 10-2014-0052531 A 5/2014

* cited by examiner

*Primary Examiner* — Robert Rose
(74) *Attorney, Agent, or Firm* — Baker & Hostetler LLP

(57) ABSTRACT

A polishing apparatus which can allow easy replacement of a retainer ring and can allow the retainer ring to be secured to a drive ring without causing deformation of the retainer ring is disclosed. The polishing head includes a head body having a substrate contact surface, a drive ring coupled to the head body, and a retainer ring surrounding the substrate contact surface and coupled to the drive ring. A first screw thread is formed on the drive ring, a second screw thread, which engages with the first screw thread, is formed on the retainer ring. The second screw thread extends in a circumferential direction of the retainer ring.

29 Claims, 37 Drawing Sheets

POLISHING APPARATUS, POLISHING HEAD, AND RETAINER RING

CROSS REFERENCE TO RELATED APPLICATIONS

This document claims priorities to Japanese Patent Application No. 2015-105793 filed May 25, 2015, Japanese Patent Application No. 2016-007265 filed Jan. 18, 2016 and Japanese Patent Application No. 2016-096466 filed May 12, 2016, the entire contents of which are hereby incorporated by reference.

BACKGROUND

A CMP apparatus, which is a polishing apparatus, is configured to press a wafer against a polishing pad while supplying a polishing liquid (or slurry) onto the polishing pad to thereby polish the wafer. The polishing pad is supported on a polishing table, and is rotated together with the polishing table. The wafer is rotated by a polishing head, and is pressed against the rotating polishing pad by the polishing head. During polishing of the wafer, a lateral force acts on the wafer due to a friction between the wafer and the polishing pad. Thus, in order to prevent the wafer from coming off from the polishing head, the polishing head includes a retainer ring for retaining the wafer.

FIG. 39 is a schematic cross-sectional view of a conventional polishing head. A polishing head 300 includes a drive ring 302 for transmitting a torque to a retainer ring 301. The retainer ring 301 is secured to the driver ring 302. More specifically, a plurality of threaded holes 305 are formed in an upper surface of the retainer ring 301 at equal intervals. A plurality of screws 307, passing through the drive ring 302, are screwed into the threaded holes 305 of the retainer ring 301, respectively, thereby securing the retainer ring 301 to the drive ring 302.

Since the retainer ring 301 is in sliding contact with the polishing pad during polishing of a wafer W, the retainer ring 301 is gradually worn away. Therefore, the retainer ring 301 is one of consumables which must be periodically replaced. However, in order to replace the retainer ring 301, it is necessary to remove the polishing head 300 from the polishing apparatus and to disassemble the polishing head 300, because the screws 307, securing the retainer ring 301, are disposed in the polishing head 300. Therefore, it takes considerable time to replace the retainer ring 301, resulting in an increase in a downtime of the polishing apparatus.

Further, when the retainer ring 301 is fastened by the plurality of screws 307, a stress in the retainer ring 301 may vary, thus possibly causing deformation of the retainer ring 301. The retainer ring 301 has not only a function to retain the wafer W during polishing, but also a function to control an amount of rebounding of the polishing pad to thereby control a polishing rate of a peripheral portion of the wafer W. If the retainer ring 301 is deformed, the polishing rate of the peripheral portion of the wafer W may vary.

SUMMARY OF THE INVENTION

According to embodiments, there are provided a polishing head and a polishing apparatus which can allow easy replacement of a retainer ring and can allow the retainer ring to be secured to a drive ring without causing deformation of the retainer ring. Further, according to an embodiment, there is provided a retainer ring capable of being easily mounted to and easily removed from the polishing head.

Embodiments, which will be described below, relate to a polishing apparatus for polishing a substrate, such as a wafer, and more particularly relate to a polishing apparatus for polishing a substrate on a polishing pad while pressing a retainer ring against the polishing pad around the substrate. Further, the below-described embodiments relate to a polishing head and a retainer ring for use in such a polishing apparatus.

In an embodiment, there is provided a polishing apparatus comprising: a polishing table for supporting a polishing pad; a polishing head for pressing a substrate against the polishing pad; and a head motor for rotating the polishing head, wherein the polishing head includes: a head body having a substrate contact surface; a drive ring coupled to the head body; and a retainer ring surrounding the substrate contact surface and coupled to the drive ring, a first screw thread is formed on the drive ring, a second screw thread, which engages with the first screw thread, is formed on the retainer ring, and the second screw thread extends in a circumferential direction of the retainer ring.

In an embodiment, the drive ring includes an annular drive ring body and an annular protrusion which protrudes downwardly from a lower surface of the annular drive ring body, an annular recess, which houses the annular protrusion therein, is formed in an upper surface of the retainer ring, and the first screw thread is formed on a side surface of the annular protrusion, and the second screw thread is formed on a side surface of the annular recess.

In an embodiment, the annular protrusion is constituted by at least a part of a screw ring secured to the annular drive ring body.

In an embodiment, a lower surface of the annular drive ring body is in contact with the upper surface of the retainer ring.

In an embodiment, the retainer ring includes an annular retainer ring body and a recess ring, the annular recess and the second screw thread being formed in the recess ring, and the recess ring has a higher strength than the annular retainer ring body.

In an embodiment, the retainer ring includes an annular retainer ring body and an annular protrusion which protrudes upwardly from an upper surface of the annular retainer ring body, an annular recess, which houses the annular protrusion therein, is formed in a lower surface of the drive ring, and the first screw thread is formed on a side surface of the annular recess, and the second screw thread is formed on a side surface of the annular protrusion.

In an embodiment, the annular protrusion is constituted by at least a part of a screw ring secured to the annular retainer ring body.

In an embodiment, an upper surface of the annular retainer ring body is in contact with a lower surface of the drive ring.

In an embodiment, seal rings, which seal a gap between the drive ring and the retainer ring, are disposed inside and outside the first screw thread and the second screw thread, respectively.

In an embodiment, a recess, with which a tightening tool for rotating the retainer ring about its own axis can engage, is formed in an outer circumferential surface of the retainer ring.

In an embodiment, the head motor has a lock function to lock a rotation of the polishing head.

In an embodiment, a direction in which the second screw thread is tightened is opposite to a direction in which the polishing head is rotated by the head motor when the polishing head is polishing the substrate.

In an embodiment, the polishing apparatus further comprises a locking structure for the first screw thread and the second screw thread.

In an embodiment, the locking structure is a lock ring which presses the retainer ring against the drive ring.

In an embodiment, the locking structure is a lock screw which restrains the rotation of the retainer ring relative to the drive ring.

In an embodiment, the locking structure includes a pin which is vertically movably supported by the drive ring, and the retainer ring has a hole into which a distal end of the pin can be inserted.

In an embodiment, the locking structure further includes a camshaft which is rotatably supported by the drive ring, and the camshaft has a cam portion and an exposed end, the cam portion being in engagement with the pin.

In an embodiment, the polishing apparatus further comprises a looseness detector for detecting a looseness of the second screw thread relative to the first screw thread.

In an embodiment, the looseness detector is a mark detector which detects a relative position of a first mark formed on the drive ring and a second mark formed on the retainer ring.

In an embodiment, the looseness detector is a load cell which is sandwiched between the drive ring and the retainer ring.

In an embodiment, there is provided a polishing head comprising: a head body having a substrate contact surface; a drive ring coupled to the head body; and a retainer ring surrounding the substrate contact surface and coupled to the drive ring, wherein a first screw thread is formed on the drive ring, a second screw thread, which engages with the first screw thread, is formed on the retainer ring, and the second screw thread extends in a circumferential direction of the retainer ring.

In an embodiment, there is provided a retainer ring for use in a polishing head which includes a head body having a substrate contact surface and a drive ring coupled to the head body, the retainer ring comprising: a second screw thread which can engage with a first screw thread formed on the drive ring, the second screw thread extending in a circumferential direction of the retainer ring.

The retainer ring is coupled to the drive ring by the engagement of the first screw thread and the second screw thread. Specifically, by rotating the entirety of the retainer ring, the second screw thread is engaged with the first screw thread, so that the retainer ring is secured to the drive ring. When the retainer ring is rotated in the opposite direction, the first screw thread and the second screw thread are disengaged, so that the retainer ring can be removed from the drive ring. In this manner, the retainer ring can be mounted and removed by simply rotating the retainer ring. Accordingly, it is not necessary to remove the polishing head from the polishing apparatus and it is also not necessary to disassemble the polishing head. Further, since the second screw thread extends in the circumferential direction of the retainer ring, a fastening force acting between the first screw thread and the second screw thread is uniform over the entire circumference of the retainer ring. Therefore, a stress generated in the retainer ring becomes uniform, and the retainer ring is not distorted.

DESCRIPTION OF EMBODIMENTS

Figure 1:
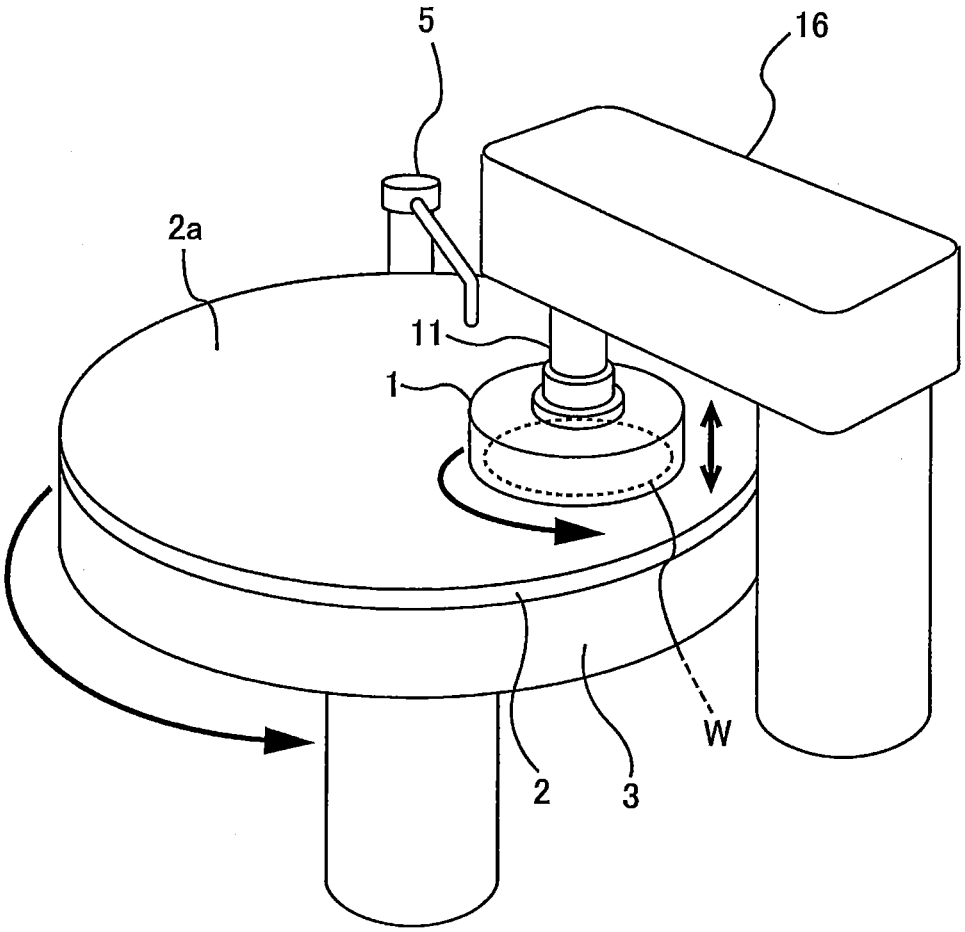
FIG. 1 is a schematic view showing a polishing apparatus according to an embodiment.

Embodiments will be described in detail below with reference to the drawings. Identical or corresponding elements are denoted by the same reference numerals throughout the drawings, and their repetitive explanations will be omitted.

FIG. 1 is a schematic view showing a polishing apparatus according to an embodiment. As shown in FIG. 1, the polishing apparatus includes a polishing head (or a substrate holder) 1 for holding and rotating a wafer W which is an example of a substrate, a polishing table 3 for supporting a polishing pad 2 thereon, and a polishing-liquid supply nozzle 5 for supplying a polishing liquid (or slurry) onto the polishing pad 2. The polishing pad 2 has an upper surface which provides a polishing surface 2*a* for polishing the wafer W.

The polishing head 1 is configured to be able to hold the wafer W on its lower surface by vacuum suction. The polishing head 1 and the polishing table 3 rotate in the same direction as indicated by arrows. In this state, the polishing head 1 presses the wafer W against the polishing surface 2*a* of the polishing pad 2. The polishing liquid is supplied from the polishing-liquid supply nozzle 5 onto the polishing pad 2, so that the wafer W is polished by sliding contact with the polishing pad 2 in the presence of the polishing liquid.

Figure 2:
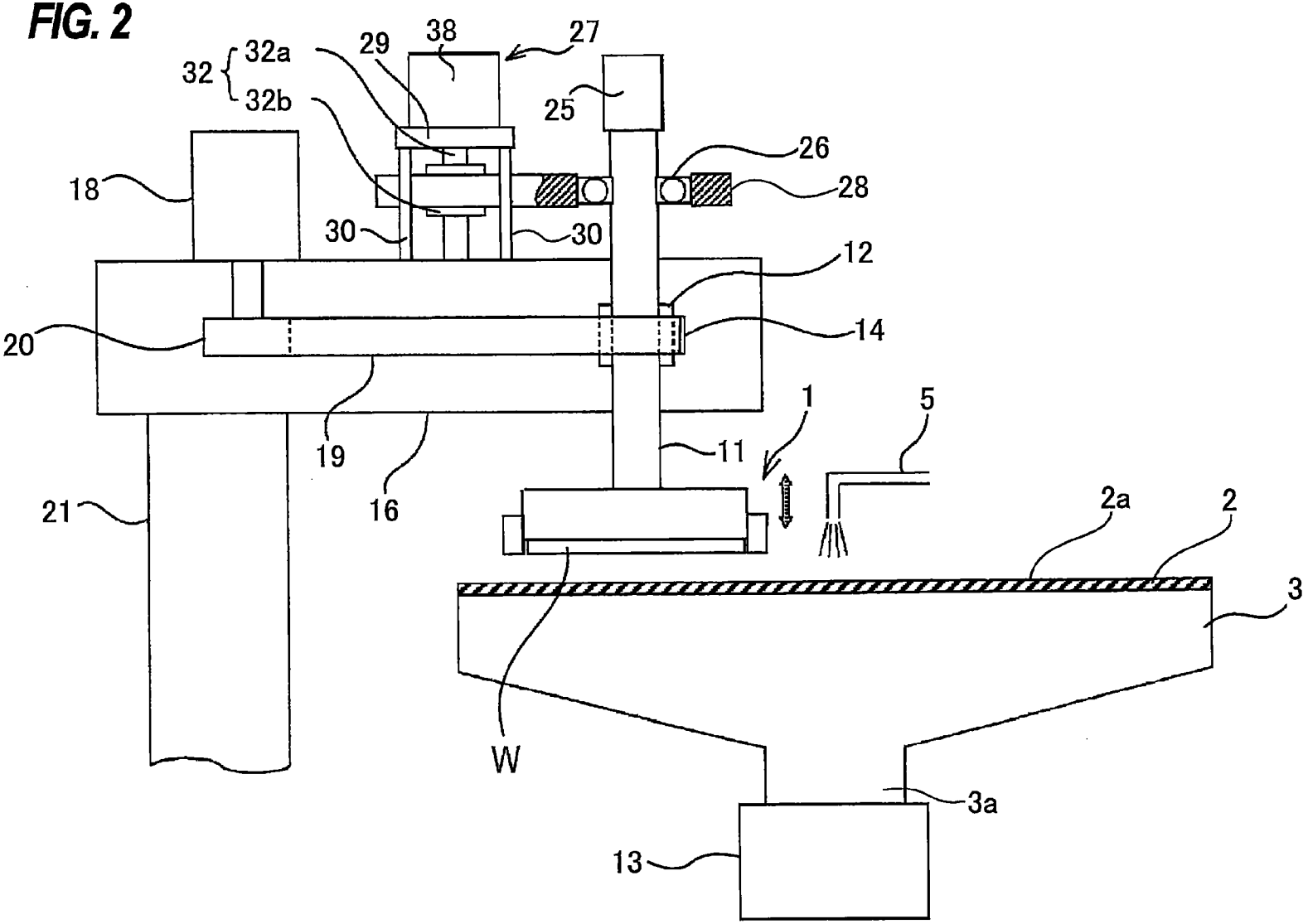
FIG. 2 is a view showing a detailed structure of the polishing apparatus.

FIG. 2 is a view showing a detailed structure of the polishing apparatus. The polishing table 3 is coupled to a table motor 13 through a table shaft 3*a* and is rotated about the table shaft 3*a* by the table motor 13 which is disposed below the polishing table 3. The polishing pad 2 is attached to an upper surface of the polishing table 3. When the polishing table 3 is rotated by the table motor 13, the polishing surface 2*a* moves relative to the polishing head 1. Therefore, the table motor 13 serves as a polishing-surface moving mechanism for moving the polishing surface 2*a* horizontally.

The polishing head 1 is coupled to a head shaft 11, which is vertically movable relative to a head arm 16 by a vertically moving mechanism 27. The vertical movement of the head shaft 11 causes a vertical movement of the entirety of the polishing head 1 relative to the head arm 16 and enables positioning of the polishing head 1. A rotary joint 25 is mounted to an upper end of the head shaft 11.

The vertically moving mechanism 27 for elevating and lowering the head shaft 11 and the polishing head 1 includes a bridge 28 for rotatably supporting the head shaft 11 through a bearing 26, a ball screw 32 mounted to the bridge 28, a support base 29 supported by pillars 30, and a servomotor 38 mounted to the support base 29. The support base 29 for supporting the servomotor 38 is secured to the head arm 16 through the pillars 30.

The ball screw 32 has a screw shaft 32*a* coupled to the servomotor 38 and a nut 32*b* which is in engagement with the screw shaft 32*a*. The head shaft 11 is configured to move vertically together with the bridge 28. Therefore, when the servomotor 38 is set in motion, the bridge 28 moves vertically through the ball screw 32 to cause the head shaft 11 and the polishing head 1 to move vertically.

The head shaft 11 is further coupled to a rotary cylinder 12 through a key (not shown). This rotary cylinder 12 has a timing pulley 14 on its outer circumferential surface. A head motor 18 is secured to the head arm 16, and the timing pulley 14 is coupled through a timing belt 19 to a timing pulley 20 which is secured to the head motor 18. Therefore, when the head motor 18 is set in motion, the rotary cylinder 12 and the head shaft 11 are rotated together through the timing pulley 20, the timing belt 19, and the timing pulley 14, thus rotating the polishing head 1 about its own axis. The head motor 18, the timing pulley 20, the timing belt 19, and the timing pulley 14 constitute a polishing-head rotating mechanism for rotating the polishing head 1 about its own axis. The head arm 16 is supported by a head arm shaft 21, which is rotatably supported by a frame (not shown).

The polishing head 1 is configured to be able to hold a substrate, such as the wafer W, on its lower surface. The head arm 16 is configured to be able to pivot on the head arm shaft 21, so that the polishing head 1, holding the wafer W on its lower surface, is moved from a receiving position of the wafer W to a position above the polishing table 3 by the pivotal movement of the head arm 16. The polishing head 1 and the polishing table 3 are rotated individually, while the polishing liquid is supplied onto the polishing pad 2 from the polishing-liquid supply nozzle 5 disposed above the polishing table 3.

The polishing head 1 is lowered and then presses the wafer W against the polishing surface 2*a* of the polishing pad 2. In this manner, the wafer W is placed in sliding contact with the polishing surface 2*a* of the polishing pad 2 to polish a surface of the wafer W.

Figure 3:
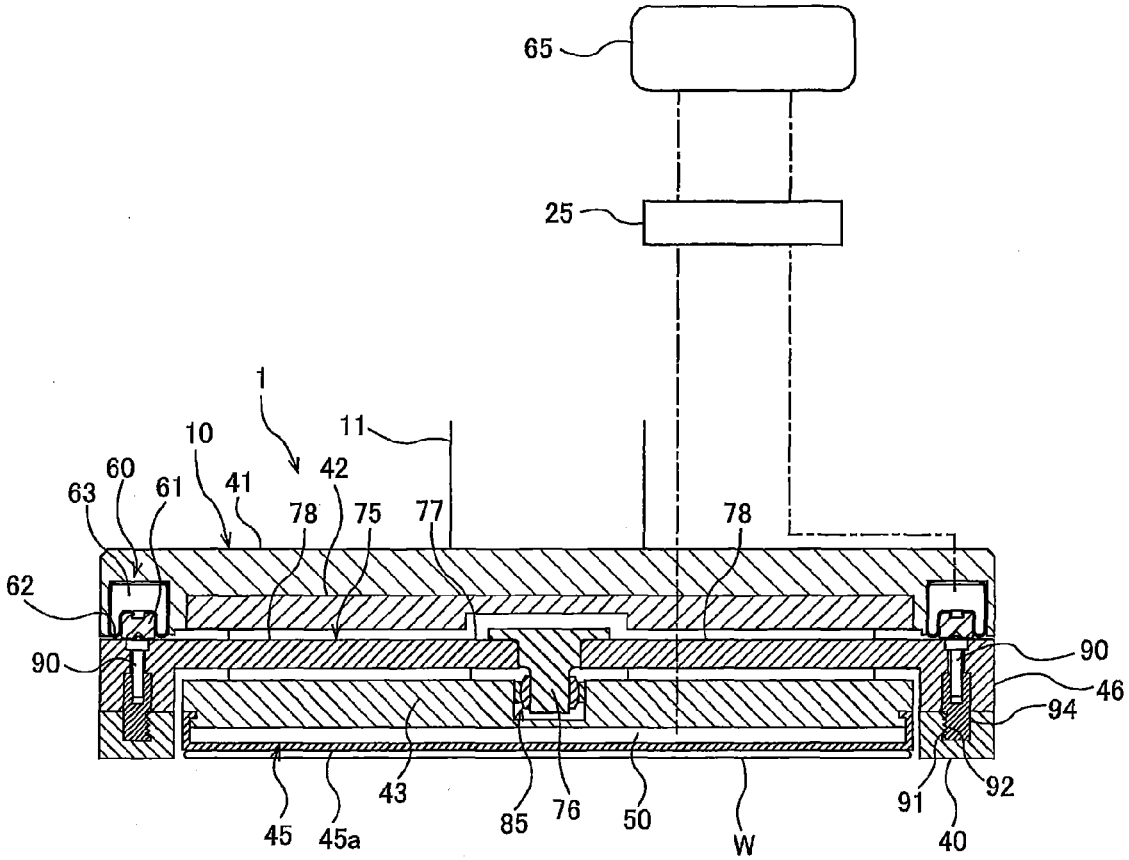
FIG. 3 is a cross-sectional view of a polishing head.

Next, the polishing head 1, which serves as the substrate holder, will be described. FIG. 3 is a cross-sectional view of the polishing head 1. The polishing head 1 is also called a top ring. As shown in FIG. 3, the polishing head 1 includes a head body 10 for pressing the wafer W against the polishing surface 2*a*, and a retainer ring 40 disposed so as to surround the wafer W. The head body 10 and the retainer ring 40 are configured to rotate together by the rotation of the head shaft 11. The retainer ring 40 is configured to be movable in the vertical direction independently of the head body 10.

The head body 10 has a circular flange 41, a spacer 42 mounted to a lower surface of the flange 41, and a carrier 43 mounted to a lower surface of the spacer 42. The flange 41 is coupled to the head shaft 11. The carrier 43 is coupled to the flange 41 through the spacer 42, so that the flange 41, the spacer 42, and the carrier 43 rotate together, and vertically move together. The flange 41, the spacer 42, and the carrier 43 are made of resin, such as engineering plastic (e.g., PEEK). The flange 41 may be made of metal, such as SUS, aluminum, or the like.

An elastic membrane 45, which is brought into contact with a back surface of the wafer W, is attached to a lower surface of the carrier 43. This elastic membrane 45 has a lower surface which serves as a substrate contact surface 45*a* to be brought into contact with the wafer W. A pressure chamber 50 is formed between the carrier 43 and the elastic membrane 45. The pressure chamber 50 is coupled to a pressure regulator 65 via the rotary joint 25, so that pressurized fluid (e.g., pressurized air) is supplied from the pressure regulator 65 into the pressure chamber 50. The elastic membrane 45 is made of a highly strong and durable rubber material, such as ethylene propylene rubber (EPDM), polyurethane rubber, silicone rubber, or the like.

The pressure chamber 50 is further coupled to a ventilation mechanism (not shown), so that the pressure chamber 50 can be ventilated to the atmosphere. The pressure chamber 50 is further coupled to a vacuum pump. A plurality of through-holes (not shown) are formed in the substrate contact surface 45*a* of the elastic membrane 45. When the vacuum pump creates a vacuum in the pressure chamber 50, the substrate contact surface 45*a* can hold the wafer W by the vacuum suction. When the wafer W is polished, the pressurized fluid (e.g., pressurized air) is supplied into the pressure chamber 50. The wafer W is pressed against the polishing surface 2*a* of the polishing pad 2 by the substrate contact surface 45*a* of the elastic membrane 45.

The retainer ring 40 is disposed around the substrate contact surface 45*a* of the elastic membrane 45. This retainer ring 40 is coupled to a drive ring 46 by a first screw thread 91 and a second screw thread 92. During polishing of the wafer W, the retainer ring 40 presses the polishing surface 2*a* of the polishing pad 2, while surrounding the wafer W which is being pressed against the polishing pad 2 by the substrate contact surface 45*a*. The wafer W is retained in the polishing head 1 by the retainer ring 40 so that the wafer W is prevented from coming off from the polishing head 1.

The drive ring 46 has an upper portion which is coupled to an annular retainer-ring pressing mechanism 60. This retainer-ring pressing mechanism 60 is configured to exert a uniform downward load on the entirety of the upper surface of the drive ring 46 to thereby press the entirety of the lower surface of the retainer ring 40 against the polishing surface 2*a* of the polishing pad 2.

The retainer-ring pressing mechanism 60 includes an annular piston 61 secured to the upper portion of the drive ring 46, and an annular rolling diaphragm 62 coupled to an upper surface of the piston 61. The rolling diaphragm 62 forms a retainer-ring pressure chamber 63 therein. This retainer-ring pressure chamber 63 is coupled to the pressure regulator 65 via the rotary joint 25. When pressurized fluid (e.g., pressurized air) is supplied from the pressure regulator 65 into the retainer-ring pressure chamber 63, the rolling diaphragm 62 pushes down the piston 61, which in turn pushes down the entireties of the drive ring 46 and the retainer ring 40. In this manner, the retainer-ring pressing mechanism 60 presses the lower surface of the retainer ring 40 against the polishing surface 2*a* of the polishing pad 2. Further, when the pressure regulator 65 or the vacuum pump (not shown) develops a negative pressure in the retainer-ring pressure chamber 63, the entireties of the retainer ring 40 and the drive ring 46 can be elevated. The retainer-ring pressure chamber 63 is further coupled to a ventilation mechanism (not shown), so that the retainer-ring pressure chamber 63 can be ventilated to the atmosphere.

The drive ring 46 is removably coupled to the retainer-ring pressing mechanism 60. More specifically, the piston 61 is made of a magnetic material such as metal, and a plurality of magnets (not shown) are disposed in the upper portion of the drive ring 46. These magnets magnetically attract the piston 61, so that the drive ring 46 is secured to the piston 61 by a magnetic force. Instead of using the magnetic force, the piston 61 and the drive ring 46 may be mechanically coupled to each other by a fastening member or the like. The drive ring 46 is coupled to a spherical bearing 85 through a coupling member 75. This spherical bearing 85 is disposed radially inwardly of the retainer ring 40.

Figure 4:
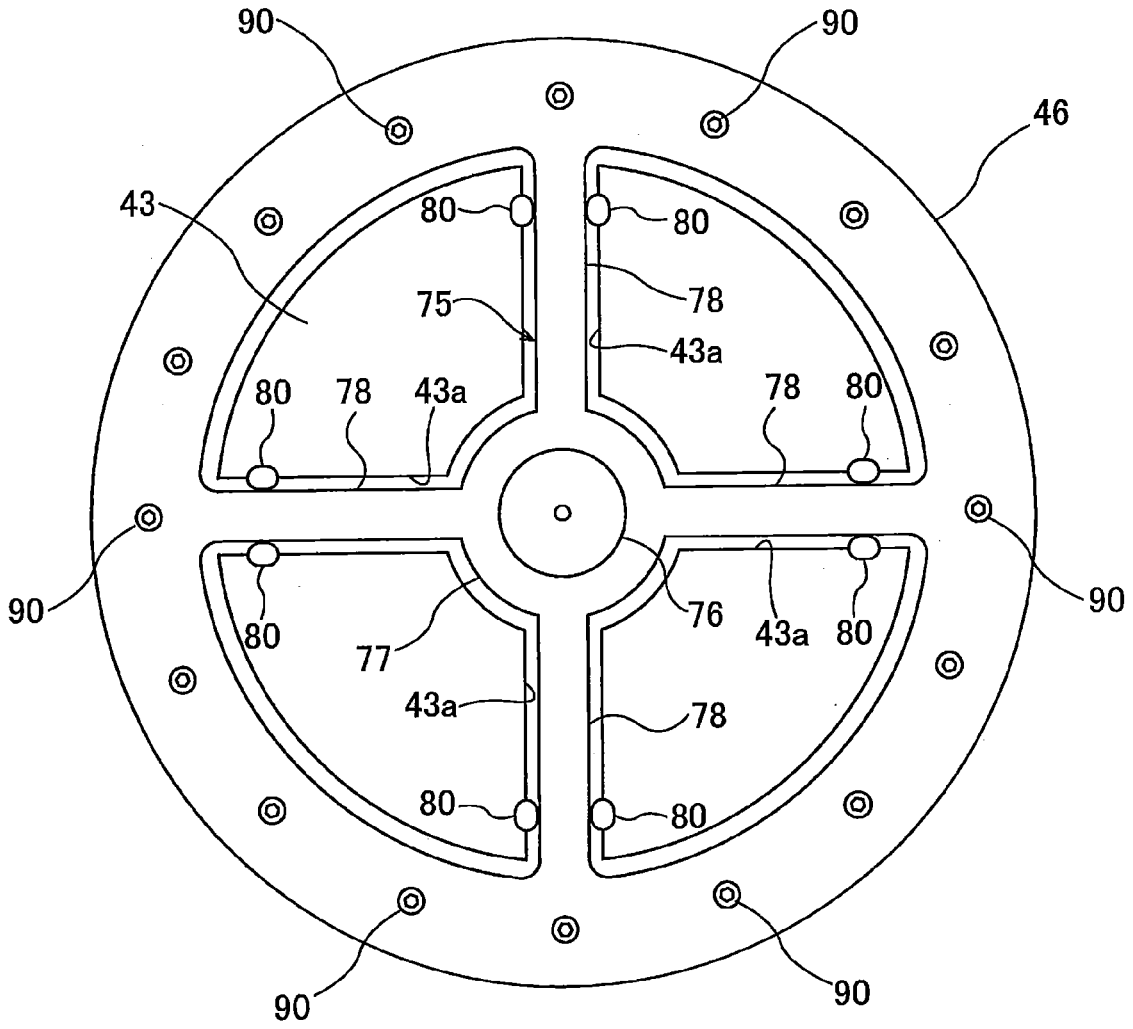
FIG. 4 is a plan view showing a drive ring and a coupling member.

FIG. 4 is a plan view showing the drive ring 46 and the coupling member 75. As shown in FIG. 4, the coupling member 75 includes a shaft portion 76 disposed centrally in the head body 10, a hub 77 secured to the shaft portion 76, and a plurality of spokes 78 extending radially from the hub 77. One ends of the spokes 78 are secured to the hub 77, and other ends of the spokes 78 are secured to the drive ring 46. The hub 77, the spokes 78, and the drive ring 46 are formed integrally. The drive ring 46 and the spokes 78 may be separate members.

Plural pairs of drive rollers 80, 80 are secured to the carrier 43. The drive rollers 80, 80 of each pair are arranged on both sides of each spoke 78, and are in rolling contact with both sides of each spoke 78. The rotation of the carrier 43 is transmitted to the spokes 78 through the drive rollers 80, 80, thereby rotating the drive ring 46 connected to the spokes 78. Therefore, the retainer ring 40, which is secured to the drive ring 46, rotates together with the head body 10.

As shown in FIG. 3, the shaft portion 76 extends vertically in the spherical bearing 85. The shaft portion 76 of the coupling member 75 is supported by the spherical bearing 85, which is arranged at the center of the head body 10, such that the shaft portion 76 can move in the vertical direction. As shown in FIG. 4, the carrier 43 has a plurality of radial grooves 43*a* in which the spokes 78 are disposed, respectively. Each spoke 78 is movable freely in the vertical direction in each groove 43*a*.

With these configurations, the drive ring 46 and the retainer ring 40, which are coupled to the coupling member 75, are vertically movable relative to the head body 10. Further, the drive ring 46 and the retainer ring 40 are tiltably supported by the spherical bearing 85. The retainer ring 40 is tillable and vertically movable relative to the substrate contact surface 45*a* and the wafer W pressed by the substrate contact surface 45*a*, and is capable of pressing the polishing pad 2 independently of the wafer W.

Figure 5:
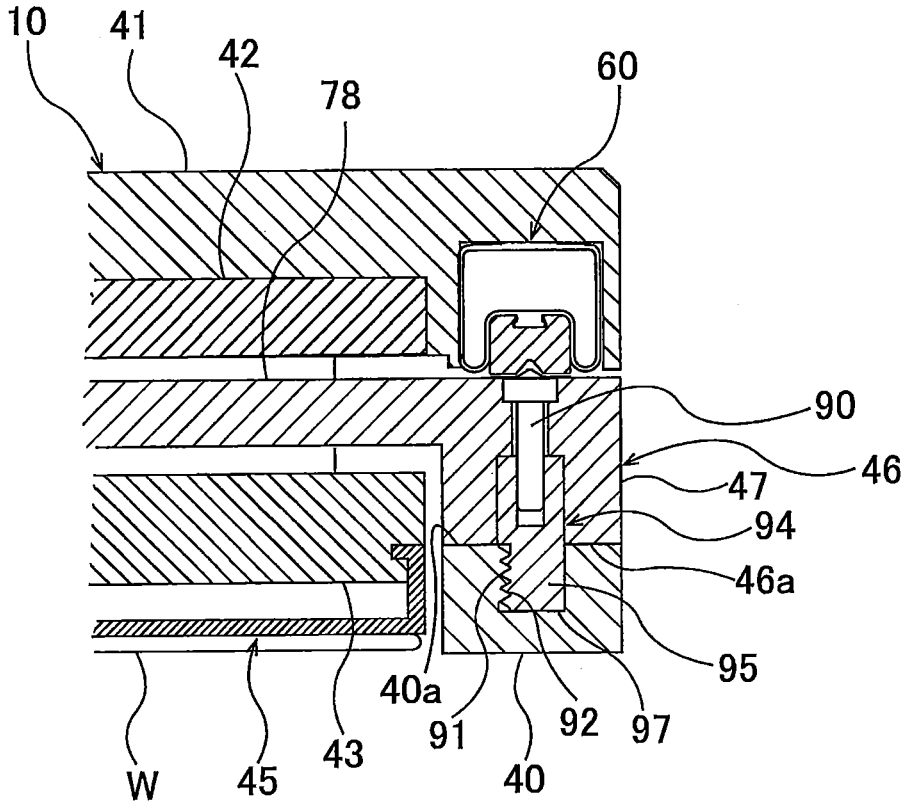
FIG. 5 is an enlarged cross-sectional view of a retainer ring and the drive ring.

FIG. 5 is an enlarged cross-sectional view of the retainer ring 40 and the drive ring 46. The retainer ring 40 is coupled to the drive ring 46 by an engagement of the first screw thread 91 and the second screw thread 92. The drive ring 46 includes an annular drive ring body 47, and an annular protrusion 95 which protrudes downwardly from a lower surface 46*a* of the annular drive ring body 47. The annular protrusion 95 is constituted by a lower part of a screw ring 94 which is secured to the annular drive ring body 47.

The first screw thread 91 and the second screw thread 92 are helical screw ridges that engage with each other. The first screw thread 91 is formed on the screw ring 94 of the drive ring 46, and the second screw thread 92 is formed on the retainer ring 40. The first screw thread 91 extends in a circumferential direction of the drive ring 46, and the second screw thread 92 extends in a circumferential direction of the retainer ring 40. The first screw thread 91 is formed over an entire circumference of the drive ring 46, and the second screw thread 92 is formed over an entire circumference of the retainer ring 40. When the retainer ring 40 is rotated, the first screw thread 91 and the second screw thread 92 are disengaged, so that the retainer ring 40 can be removed from the drive ring 46. The first screw thread 91 may not necessarily extend continuously. The first screw thread 91 may be partially discontinuous, so long as the first screw thread 91 is formed over the entire circumference of the drive ring 46. Similarly, the second screw thread 92 may not necessarily extend continuously, and thus the second screw thread 92 may be partially discontinuous, so long as the second screw thread 92 is formed over the entire circumference of the retainer ring 40.

Figure 6:
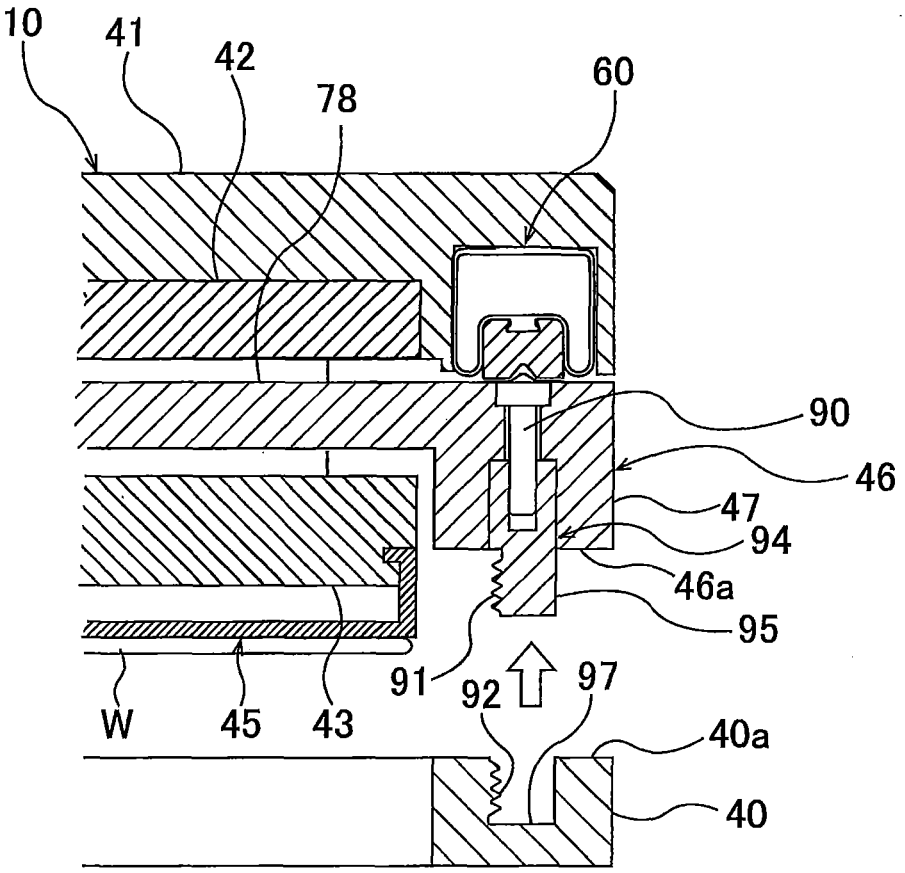
FIG. 6 is an enlarged cross-sectional view of the retainer ring and the drive ring when a first screw thread and a second screw thread shown in FIG. 5 are disengaged.

FIG. 6 is an enlarged cross-sectional view of the retainer ring 40 and the drive ring 46 when the first screw thread 91 and the second screw thread 92 are disengaged. The screw ring 94 is secured to the annular drive ring body 47 by a plurality of mounting screws 90. These mounting screws 90 are arranged at equal intervals along the circumferential direction of the drive ring 46 (see FIG. 4). Each mounting screw 90 extends through the annular drive ring body 47, and is screwed into the screw ring 94. An upper portion of the screw ring 94 is embedded in the annular drive ring body 47, and the lower portion of the screw ring 94 forms the annular protrusion 95 which protrudes downwardly from the lower surface 46*a* of the annular drive ring body 47.

In this embodiment, from the viewpoint of easiness of forming the first screw thread 91, the annular protrusion 95 is constituted by a part of the screw ring 94 which is a separate member from the annular drive ring body 47. The screw ring 94 may be secured to the lower surface 46*a* of the annular drive ring body 47 such that the annular protrusion 95 is constituted by the entirety of the screw ring 94. In order to more firmly secure the screw ring 94 to the annular drive ring body 47, the screw ring 94 may be glued to the annular drive ring body 47, and be then secured by the mounting screws 90. The screw ring 94 and the annular drive ring body 47 may be integrally made of the same material to form the drive ring 46.

The annular protrusion 95 extends over the entire circumference of the annular drive ring body 47, and is concentric with the annular drive ring body 47 and the retainer ring 40. The first screw thread 91 is formed on an inner side surface of the annular protrusion 95. An annular recess 97, which houses the annular protrusion 95 therein, is formed in the upper surface of the retainer ring 40. The second screw thread 92 is formed on an inner side surface of the annular recess 97. The annular recess 97 extends over the entire circumference of the retainer ring 40, and is concentric with the retainer ring 40. In this embodiment, the first screw thread 91 is a female thread, and the second screw thread 92 is a male thread.

By rotating the entirety of the retainer ring 40 about its own axis, the second screw thread 92 is engaged with the first screw thread 91 as shown in FIG. 5, so that the retainer ring 40 can be coupled (i.e., secured) to the drive ring 46. Further, by rotating the entirety of the retainer ring 40 about its own axis in the opposite direction, the first screw thread 91 and the second screw thread 92 are disengaged, so that the retainer ring 40 can be removed from the drive ring 46 as shown in FIG. 6.

In this manner, the retainer ring 40 can be attached and removed by simply rotating the retainer ring 40. Therefore, it is not necessary to remove the polishing head 1 from the polishing apparatus, and it is also not necessary to disassemble the polishing head 1. Further, a fastening force acting between the first screw thread 91 and the second screw thread 92 is uniform over the entire circumference of the retainer ring 40, because the first screw thread 91 and the second screw thread 92 continuously (or discontinuously) extend over the entire circumference of the retainer ring 40. Therefore, a stress generated in the retainer ring 40 also becomes uniform, and as a result, the retainer ring 40 is not distorted.

When the polishing head 1 is rotating, a torque acts on the retainer ring 40 due to a friction between the retainer ring 40 and the polishing pad 2. In order to prevent the first screw thread 91 and the second screw thread 92 from being loosened during polishing of the wafer W, a direction in which the second screw thread 92 is tightened may be opposite to a direction in which the polishing head 1 (and the retainer ring 40) is rotated by the head motor 18 (see FIG. 2) when the wafer W is polished. It is noted that this anti-looseness mechanism is not necessary if a sufficient fastening force can be achieved by the first screw thread 91 and the second screw thread 92.

As shown in FIG. 5, the retainer ring 40 is coupled to the drive ring 46, with the upper surface 40*a* of the retainer ring 40 being pressed against the lower surface 46*a* of the annular drive ring body 47 of the drive ring 46 by the fastening force of the first screw thread 91 and the second screw thread 92. The lower surface 46*a* of the annular drive ring body 47 is in contact with the upper surface 40*a* of the retainer ring 40. The first screw thread 91 and the second screw thread 92 are completely enclosed by the drive ring 46 and the retainer ring 40 such that these screw threads 91, 92 are not exposed to the exterior. Therefore, during polishing of the wafer W, the polishing liquid (or slurry) does not reach the first screw thread 91 and the second screw thread 92, so that a smooth removal of the retainer ring 40 can be ensured.

Figure 7:
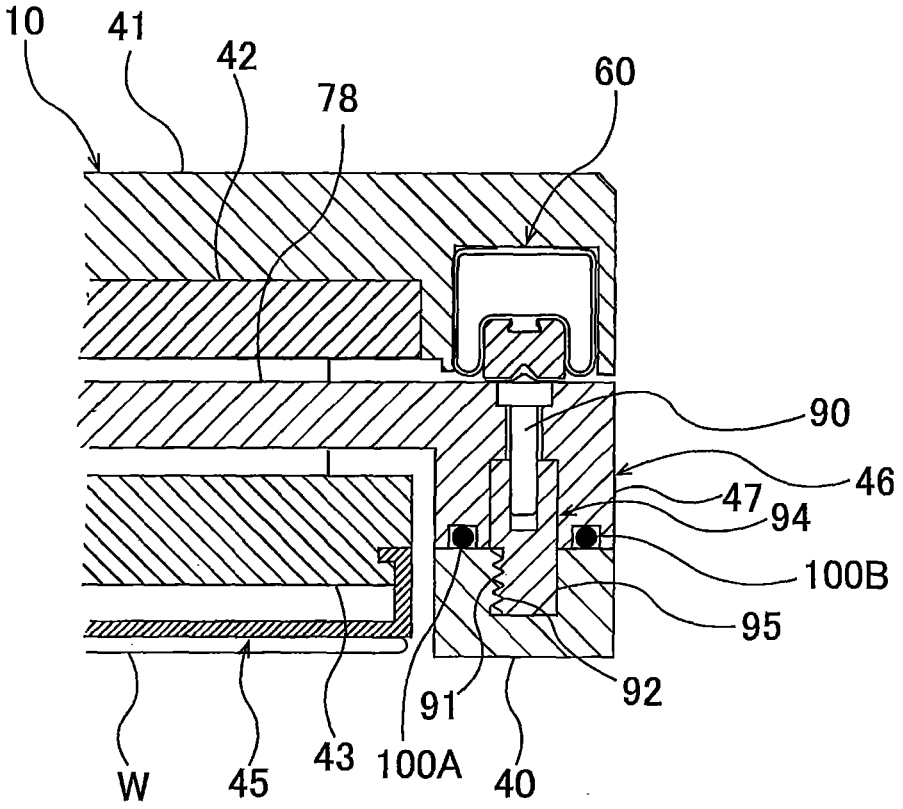
FIG. 7 is a view showing an embodiment in which seal rings are provided between the drive ring and the retainer ring.

In order to more reliably prevent the entry of the polishing liquid (slurry), as shown in FIG. 7, seal rings 100A, 100B, such as O-rings, may preferably be provided between the drive ring 46 and the retainer ring 40. In an embodiment shown in FIG. 7, the inner seal ring 100A, which is an O-ring, is disposed inside the first screw thread 91 and the second screw thread 92. The outer seal ring 100B, which is an O-ring, is disposed outside the first screw thread 91 and the second screw thread 92. These two seal rings 100A, 100B seal a gap between the drive ring 46 and the retainer ring 40, more specifically a gap between the lower surface 46*a* of the annular drive ring body 47 and the upper surface 40*a* of the retainer ring 40.

Figure 8:
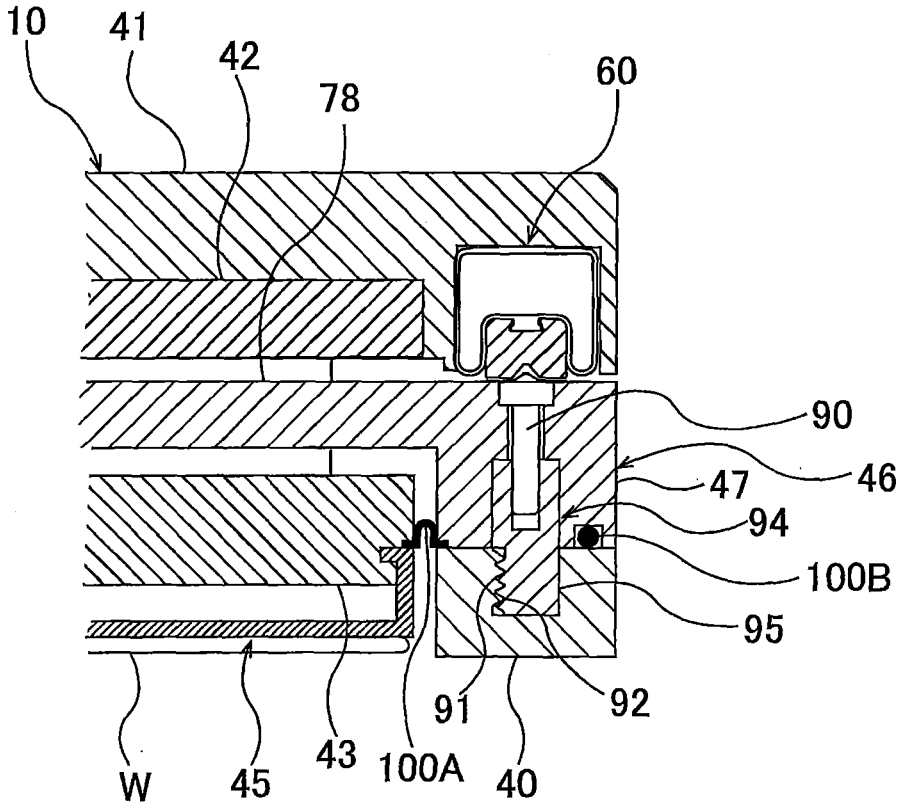
FIG. 8 is a view showing another embodiment in which seal rings are provided between the drive ring and the retainer ring.

In an embodiment shown in FIG. 8, the inner seal ring 100A has an inverted U-shaped cross section. An inner circumferential edge of the inner seal ring 100A is connected to the carrier 43 of the head body 10, and an outer circumferential edge of the inner seal ring 100A is sandwiched between the drive ring 46 and the retainer ring 40, more specifically between the lower surface 46*a* of the annular drive ring body 47 and the upper surface 40*a* of the retainer ring 40. The inverted U-shaped inner seal ring 100A has a shape that can prevent the slurry from entering a space between the elastic membrane (or the membrane) 45 and the retainer ring 40, and does not obstruct the vertical movement of the retainer ring 40. The inner seal ring 100A shown in FIG. 8 may be integral with the elastic membrane 45.

Figure 9:
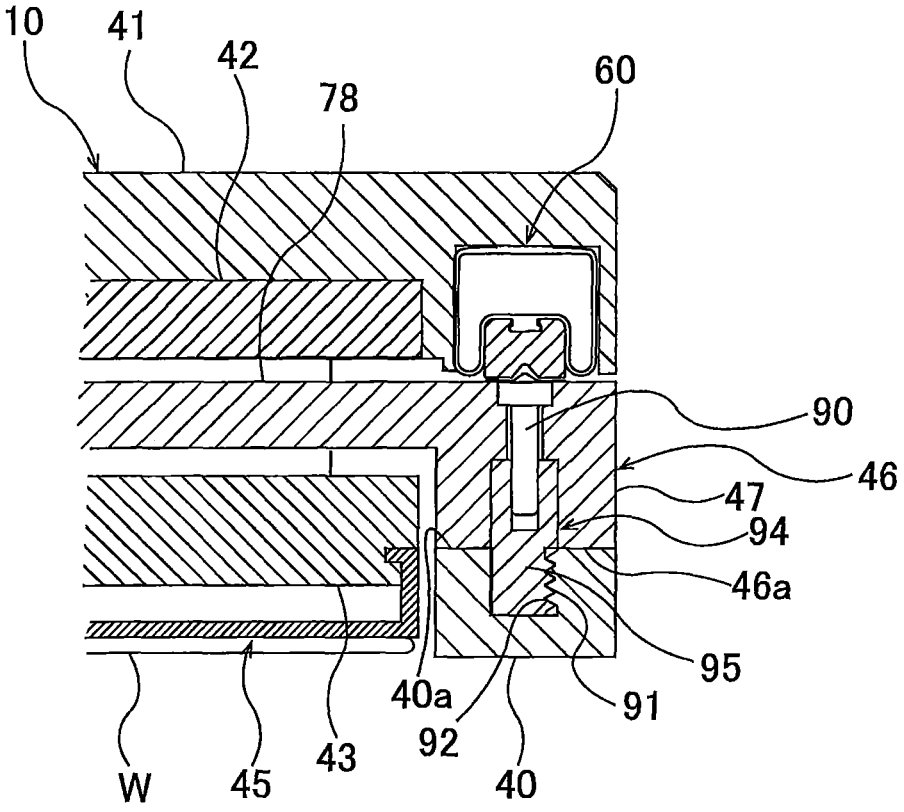
FIG. 9 is an enlarged cross-sectional view showing another embodiment of the retainer ring and the drive ring.
Figure 10:
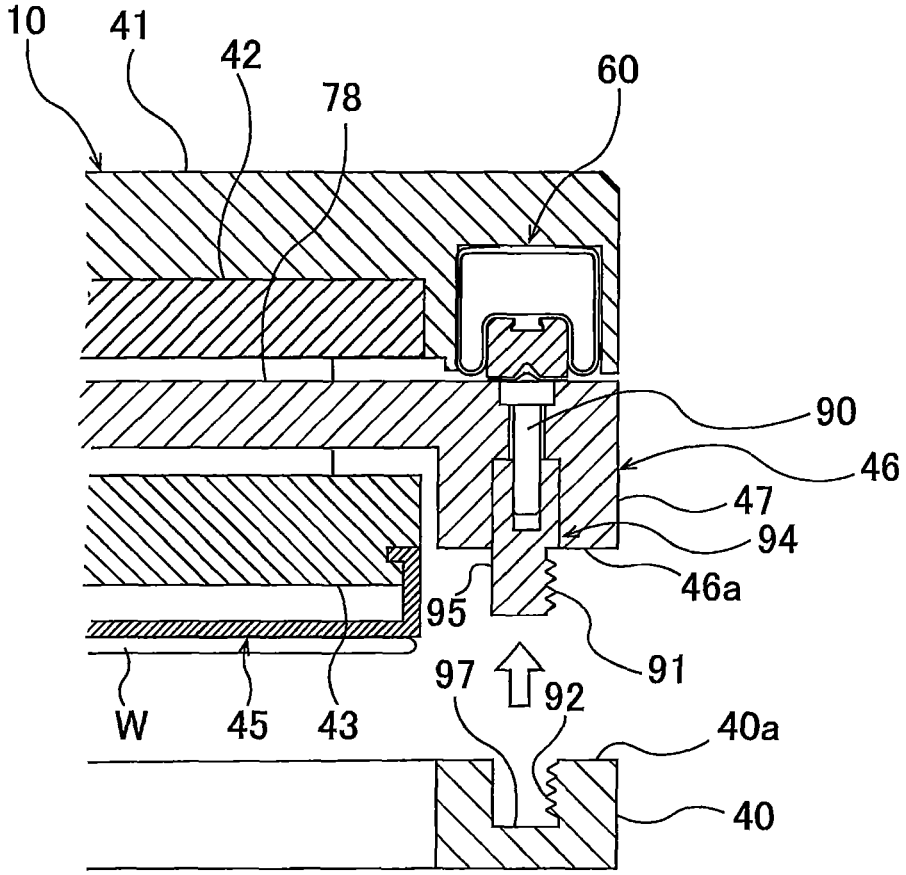
FIG. 10 is an enlarged cross-sectional view of the retainer ring and the drive ring when the first screw thread and the second screw thread shown in FIG. 9 are disengaged.

FIG. 9 is an enlarged cross-sectional view showing another embodiment of the retainer ring 40 and the drive ring 46. FIG. 10 is an enlarged cross-sectional view of the retainer ring 40 and the drive ring 46 when the first screw thread 91 and the second screw thread 92 shown in FIG. 9 are disengaged. In this embodiment, the first screw thread 91 is formed on an outer side surface of the annular protrusion 95, and the second screw thread 92 is formed on an outer side surface of the annular recess 97. The first screw thread 91 is a male thread, and the second screw thread 92 is a female thread. As with the embodiment shown in FIG. 7 and FIG. 8, the seal rings 100A, 100B, such as O-rings, may be provided between the drive ring 46 and the retainer ring 40.

According to both the embodiment shown in FIG. 5 and FIG. 6 and the embodiment shown in FIG. 9 and FIG. 10, the retainer ring 40 can be secured to the drive ring 46 by the engagement of the first screw thread 91 and the second screw thread 92. Because there is a difference in position where the fastening force is generated between these embodiments, it is preferable to select proper one of the embodiments according to polishing conditions.

Figure 11:
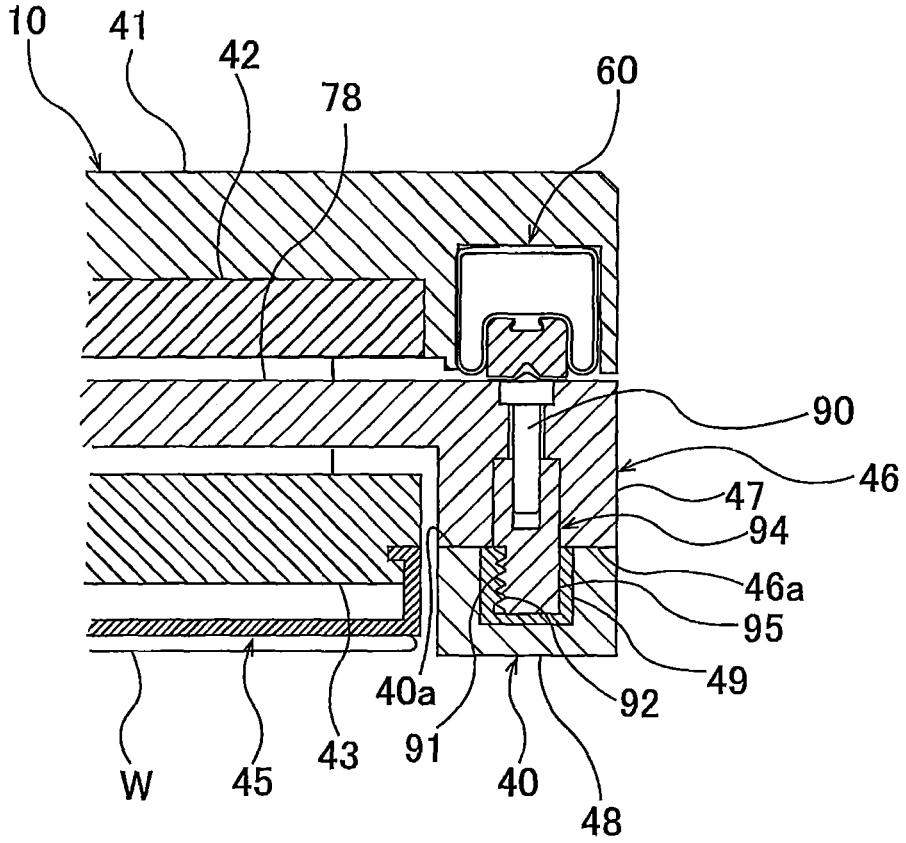
FIG. 11 is a view showing another embodiment of the retainer ring.
Figure 12:
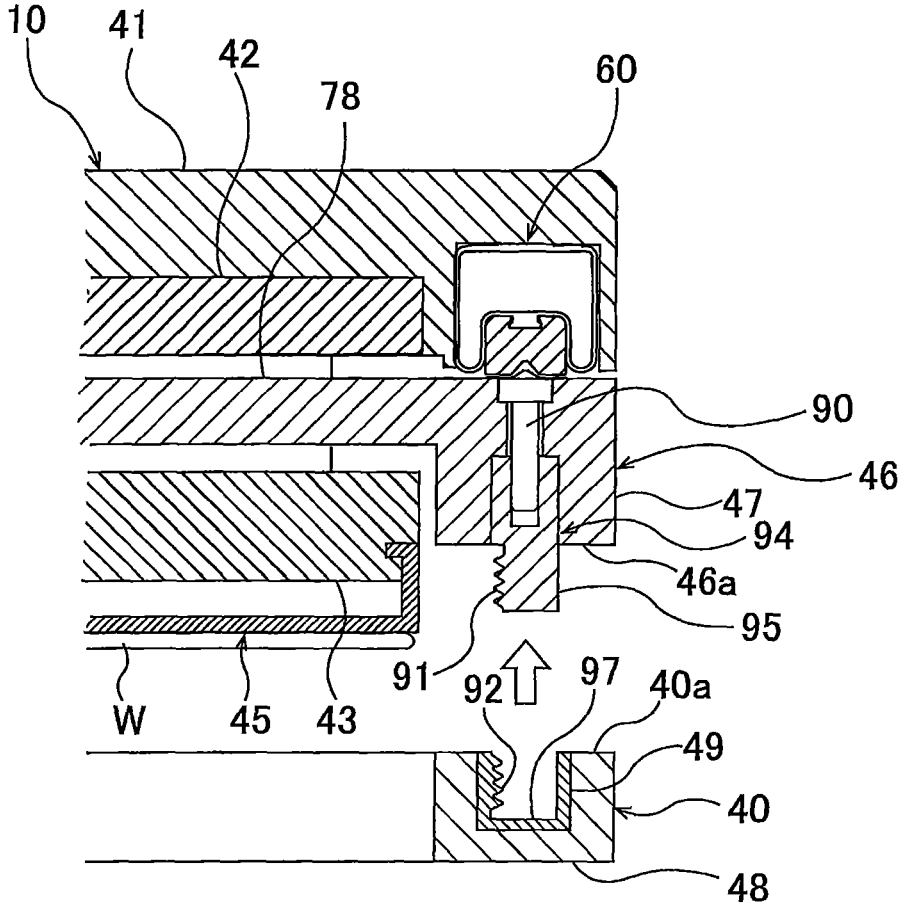
FIG. 12 is an enlarged cross-sectional view of the retainer ring and the drive ring when the first screw thread and the second screw thread shown in FIG. 11 are disengaged.

FIG. 11 and FIG. 12 are views each showing another embodiment of the retainer ring 40. In this embodiment, the retainer ring 40 includes an annular retainer ring body 48, and a recess ring 49 disposed in the annular retainer ring body 48. The annular retainer ring body 48 has a lower surface which provides a pressing surface for pressing the polishing pad 2. The above-described annular recess 97 and second screw thread 92 are formed in the recess ring 49. The recess ring 49 is secured to the annular retainer ring body 48 by adhesion, press fitting, welding, or the like.

Figure 13:
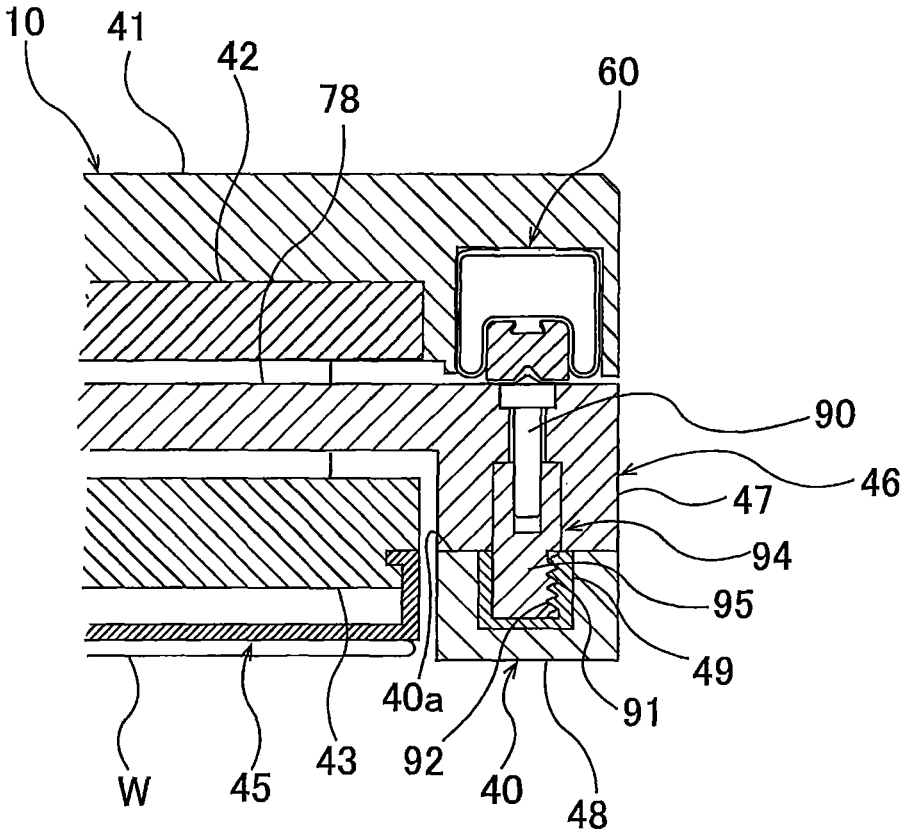
FIG. 13 is a view showing another embodiment of the retainer ring.

The annular retainer ring body 48 is made of resin, while the recess ring 49 is made of a material having a higher strength than the annular retainer ring body 48, such as metal, ceramic, carbon, or PEEK. From the viewpoint of cost, a stainless steel having a high corrosion-resistance is preferably used. In a case where an eddy current sensor is used for measuring a film thickness of the wafer W, the recess ring 49 is preferably made of a non-metal material having a high strength, such as ceramic. As shown in FIG. 13, the recess ring 49 may be applied to the embodiment shown in FIG. 9 and FIG. 10.

Figure 14:
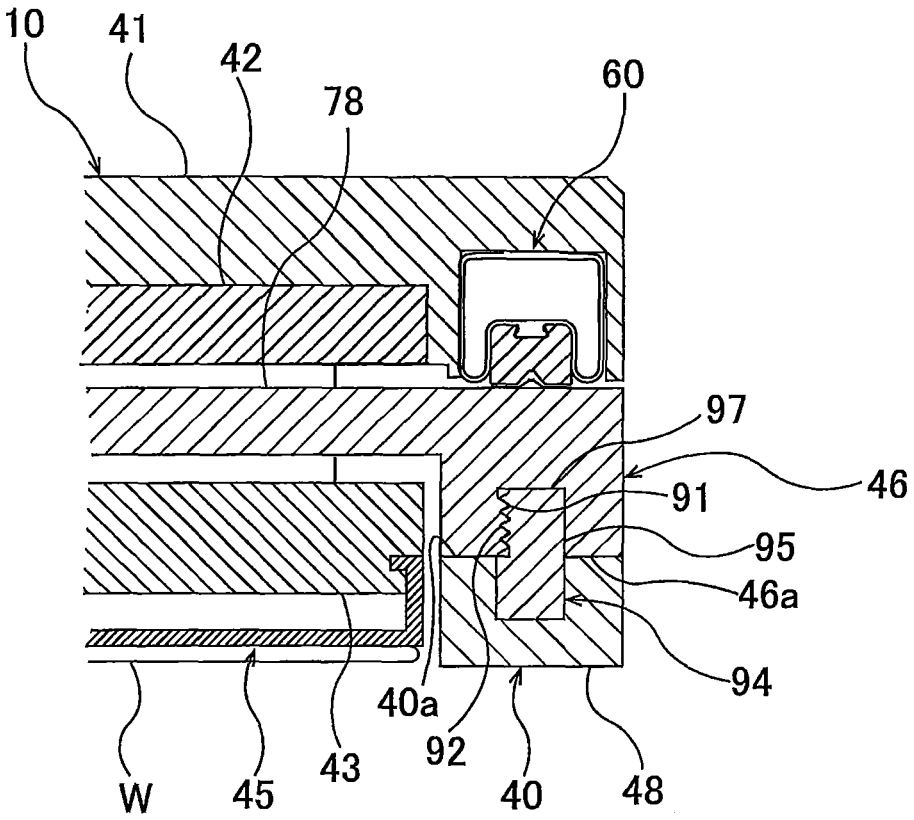
FIG. 14 is an enlarged cross-sectional view showing another embodiment of the retainer ring and the drive ring.

FIG. 14 is an enlarged cross-sectional view showing another embodiment of the retainer ring 40 and the drive ring 46. Structures which will not be described particularly in this embodiment are identical to those of the embodiment shown in FIG. 5 and FIG. 6, and repetitive descriptions thereof are omitted. In this embodiment, the retainer ring 40 includes annular retainer ring body 48, and annular protrusion 95 which protrudes upwardly from the upper surface 40*a* of the annular retainer ring body 48. The annular protrusion 95 is constituted by an upper portion of the screw ring 94 which is secured to the annular retainer ring body 48.

The annular protrusion 95 extends over the entire circumference of the annular retainer ring body 48, and is concentric with the annular retainer ring body 48. Annular recess 97, which houses the annular protrusion 95 therein, is formed in the lower surface 46*a* of the drive ring 46. The first screw thread 91 is formed on an inner side surface of the annular recess 97. The second screw thread 92 is formed on an inner side surface of the annular protrusion 95. The annular recess 97 extends over the entire circumference of the drive ring 46, and is concentric with the drive ring 46. In this embodiment, the first screw thread 91 is a male thread, and the second screw thread 92 is a female thread. The first screw thread 91 may be formed on an outer side surface of the annular recess 97, and the second screw thread 92 may be formed on an outer side surface of the annular protrusion 95.

The first screw thread 91 and the second screw thread 92 are formed over the entire circumferences of the drive ring 46 and the retainer ring 40. When the retainer ring 40 is rotated, the first screw thread 91 and the second screw thread 92 are disengaged, so that the retainer ring 40 can be removed from the drive ring 46.

Figure 15:
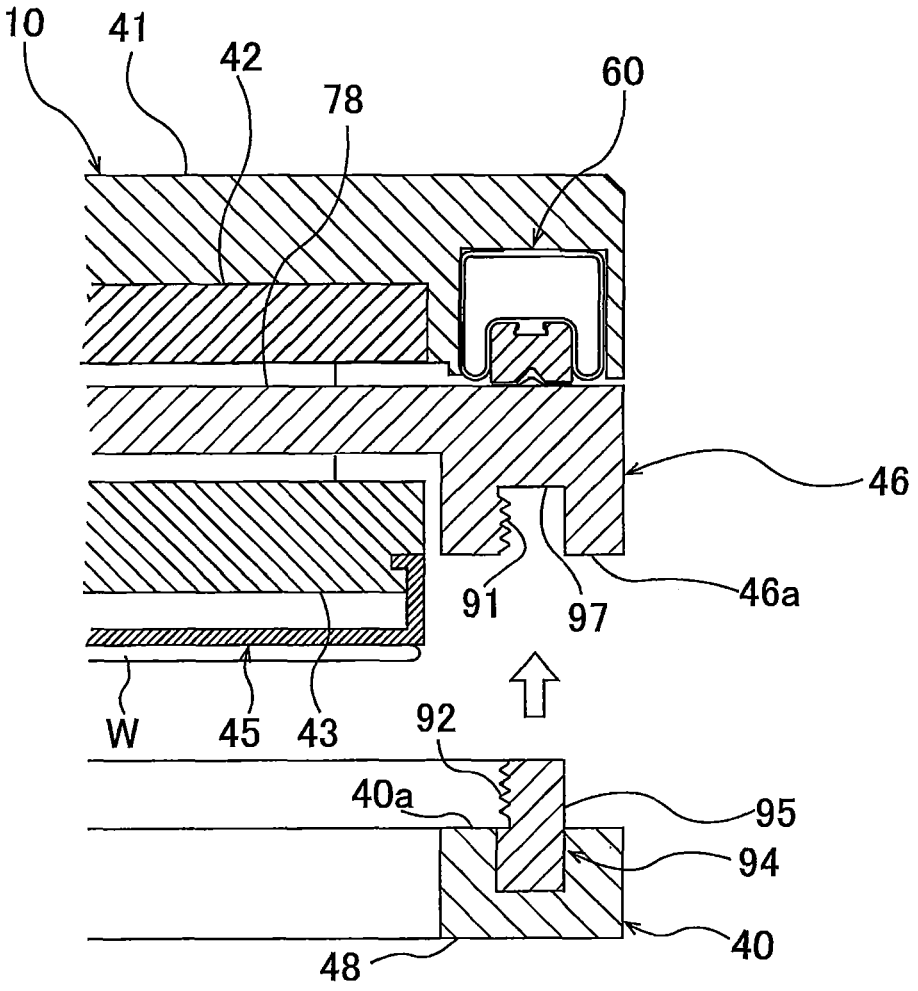
FIG. 15 is an enlarged cross-sectional view of the retainer ring and the drive ring when the first screw thread and the second screw thread shown in FIG. 14 are disengaged.

FIG. 15 is an enlarged cross-sectional view of the retainer ring 40 and the drive ring 46 when the first screw thread 91 and the second screw thread 92 shown in FIG. 14 are disengaged. The screw ring 94 is secured to the annular retainer ring body 48 by a plurality of mounting screws (not shown). A lower portion of the screw ring 94 is embedded in the annular retainer ring body 48, and an upper portion of the screw ring 94 forms the annular protrusion 95 which protrudes upwardly from the upper surface 40*a* of the annular retainer ring body 48.

In this embodiment, from the viewpoint of easiness of forming the second screw thread 92, the annular protrusion 95 is constituted by a part of the screw ring 94 which is a separate member from the annular retainer ring body 48. The screw ring 94 may be secured to the upper surface 40*a* of the annular retainer ring body 48 such that the annular protrusion 95 is constituted by the entirety of the screw ring 94. In order to more firmly secure the screw ring 94 to the annular retainer ring body 48, the screw ring 94 may be glued to the annular retainer ring body 48, and be then secured by the mounting screws (now shown). The screw ring 94 and the annular retainer ring body 48 may be integrally made of the same material to form the retainer ring 40.

As shown in FIG. 14, the retainer ring 40 is coupled to the drive ring 46, with the upper surface 40*a* of the annular retainer ring body 48 being pressed against the lower surface 46*a* of the drive ring 46 by the fastening force of the first screw thread 91 and the second screw thread 92. The lower surface 46*a* of the drive ring 46 is in contact with the upper surface 40*a* of the annular retainer ring body 48 of the retainer ring 40. The first screw thread 91 and the second screw thread 92 are completely enclosed by the drive ring 46 and the retainer ring 40 such that these screw threads 91, 92 are not exposed to the exterior. Therefore, during polishing of the wafer W, the polishing liquid (or slurry) does not reach the first screw thread 91 and the second screw thread 92, so that a smooth removal of the retainer ring 40 can be ensured. The above-described embodiments shown in FIGS. 7 through 10 can be applied to the embodiment shown in FIG. 14.

Figure 16:
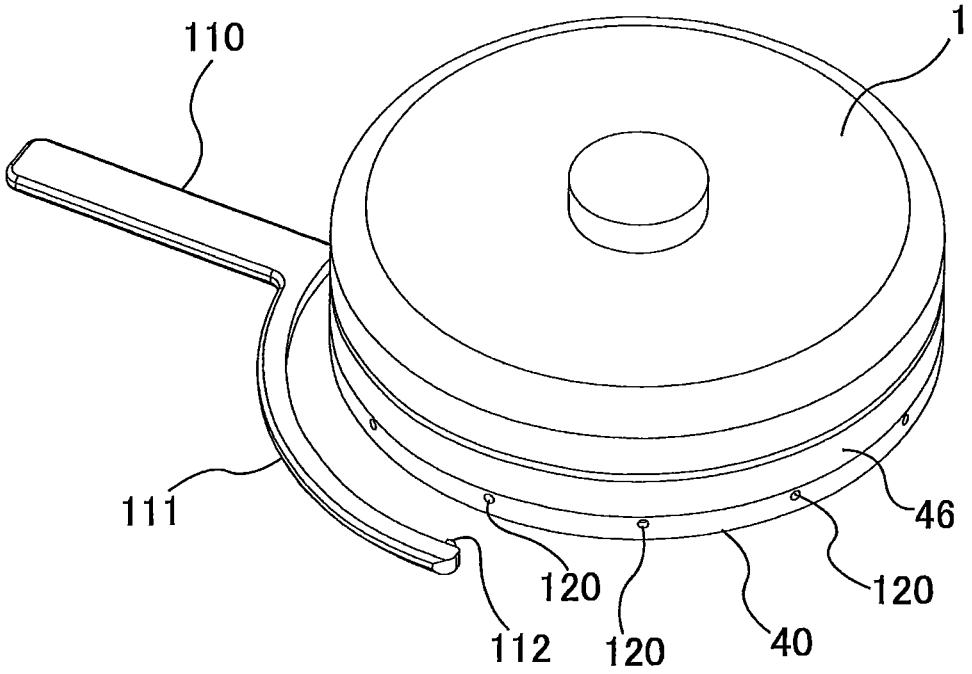
FIG. 16 is a view showing a tightening tool for rotating the retainer ring.

FIG. 16 is a view showing a tightening tool 110 for rotating the retainer ring 40. As shown in FIG. 16, the second screw thread 92 is tightened onto the first screw thread 91 with use of the dedicated tightening tool 110 for rotating the retainer ring 40. The tightening tool 110 has an arcuate arm 111 which is shaped along an outer circumferential surface of the retainer ring 40. A projection 112 is formed on a distal end of the arcuate arm 111. A plurality of recesses 120 are formed in the outer circumferential surface of the retainer ring 40, so that the projection 112 of the tightening tool 110 can engage one of the recesses 120.

Figure 17:
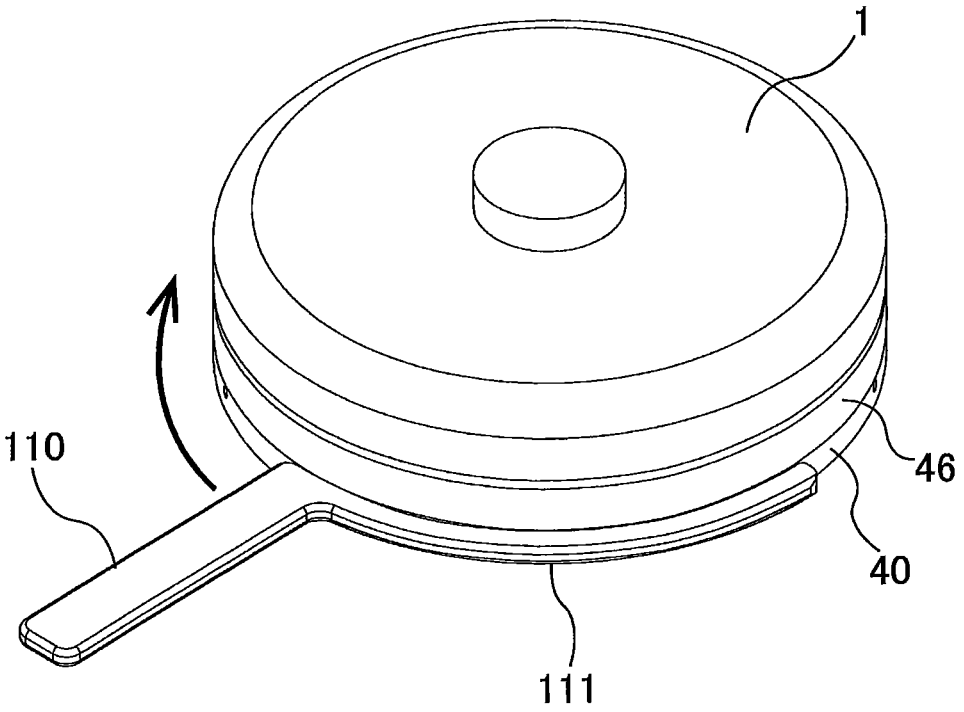
FIG. 17 is a view showing the tightening tool when rotating the retainer ring about its own axis.

The retainer ring 40 is first rotated by hand without using the tightening tool 110 until the second screw thread 92 is screwed onto the first screw thread 91 to some extent. Thereafter, the tightening tool 110 shown in FIG. 16 is used to exert a high torque on the retainer ring 40. FIG. 17 is a view showing the tightening tool 110 when rotating the retainer ring 40 about its own axis. The projection 112 of the tightening tool 110 is fitted into one of the plurality of recesses 120, and in this state, the tightening tool 110 is rotated by hand in a direction indicated by arrow.

In order to prevent the polishing head 1 from being rotated when the retainer ring 40 is rotated by the tightening tool 110, the head motor 18 (see FIG. 2) has a lock function to lock the rotation of the polishing head 1. Specifically, an electric current is passed to the head motor 18, without rotating the head motor 18, to cause the head motor 18 to generate a fixing force which is larger than a rated torque of the head motor 18. The retainer ring 40 may be rotated while a dedicated tool is fixing the head shaft 11 (see FIG. 1 and FIG. 2) which supports the polishing head 1.

If the first screw thread 91 and the second screw thread 92 are loosened during polishing of the wafer W, the position of the retainer ring 40 relative to the head body 10 changes. As a result, a polishing profile of the wafer W may vary, or the wafer W may be damaged. Thus, in order to prevent the first screw thread 91 and the second screw thread 92 from being loosened, it is preferable to provide a locking structure shown in FIGS. 18 through 23.

Figure 18:
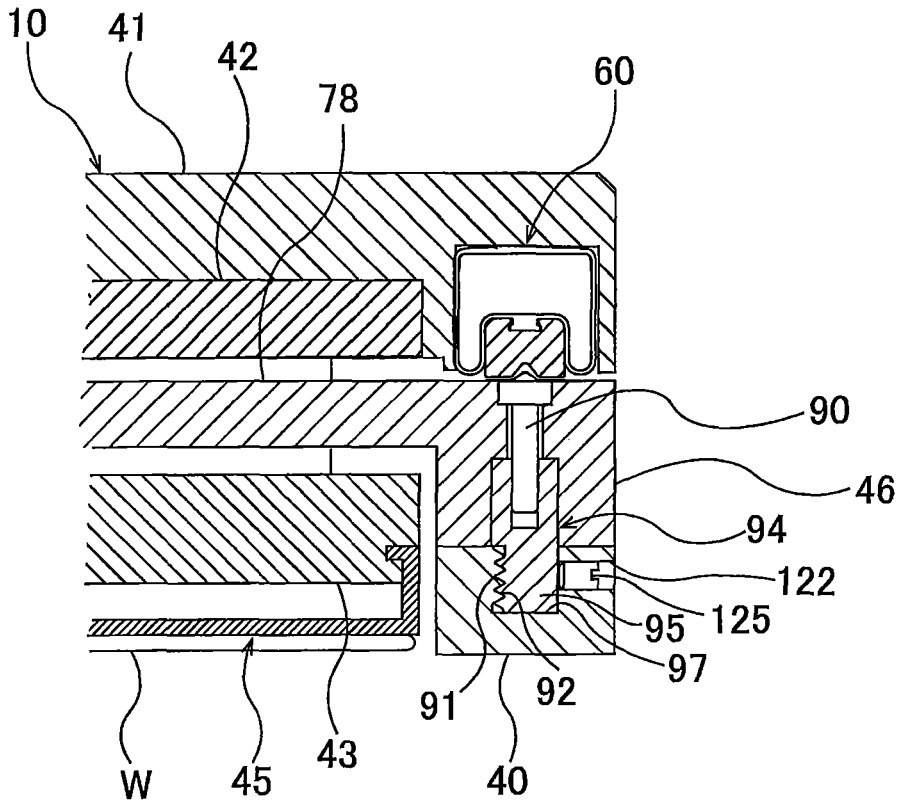
FIG. 18 is a view showing an embodiment including a locking structure which is constituted by a lock screw.

The locking structure shown in FIG. 18 comprises a lock screw 125 which restrains the rotation of the retainer ring 40 relative to the drive ring 46. This lock screw 125 is embedded in the retainer ring 40, and is in contact with the annular protrusion 95 of the drive ring 46. More specifically, a threaded hole 122, which communicates with the annular recess 97, is formed in the outer circumferential surface of the retainer ring 40, and the lock screw 125 is screwed into the threaded hole 122 until a distal end of the lock screw 125 comes into contact with the outer circumferential surface of the annular protrusion 95.

Figure 19:
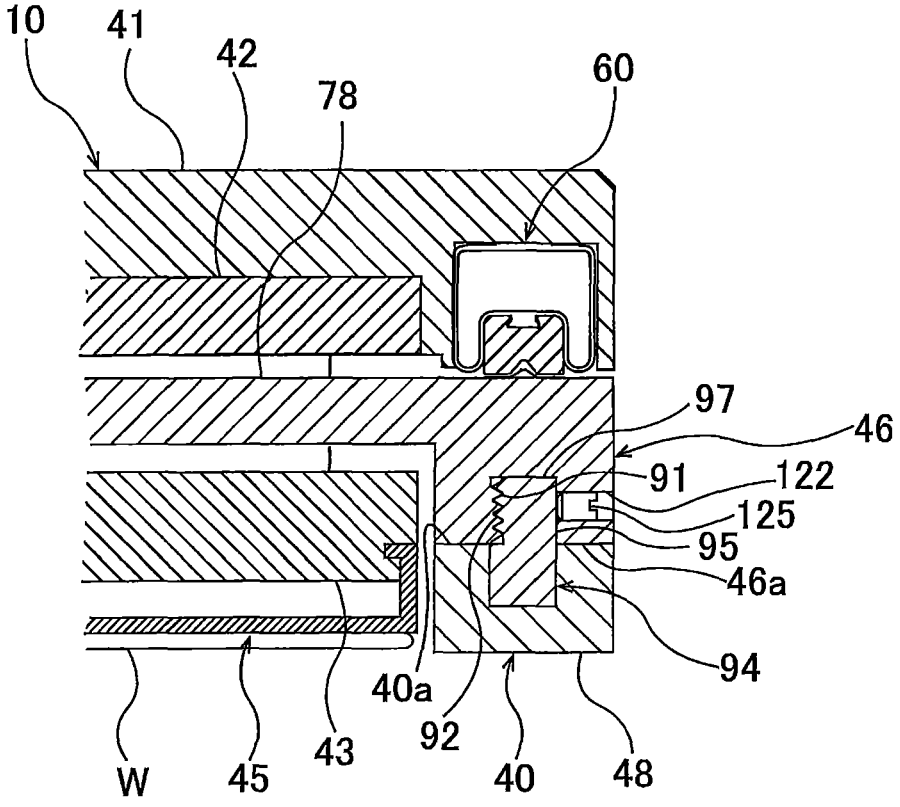
FIG. 19 is a view showing an embodiment in which the lock screw is applied to the embodiment shown in FIG. 14 and FIG. 15.

FIG. 19 is a view showing an embodiment in which the lock screw 125 is applied to the embodiment shown in FIG. 14. The lock screw 125 is embedded in the drive ring 46, and is in contact with the annular protrusion 95 of the retainer ring 40. More specifically, a threaded hole 122, which communicates with the annular recess 97, is formed in the outer circumferential surface of the drive ring 46, and the lock screw 125 is screwed into the threaded hole 122 until the distal end of the lock screw 125 comes into contact with the outer circumferential surface of the annular protrusion 95.

Figure 20:
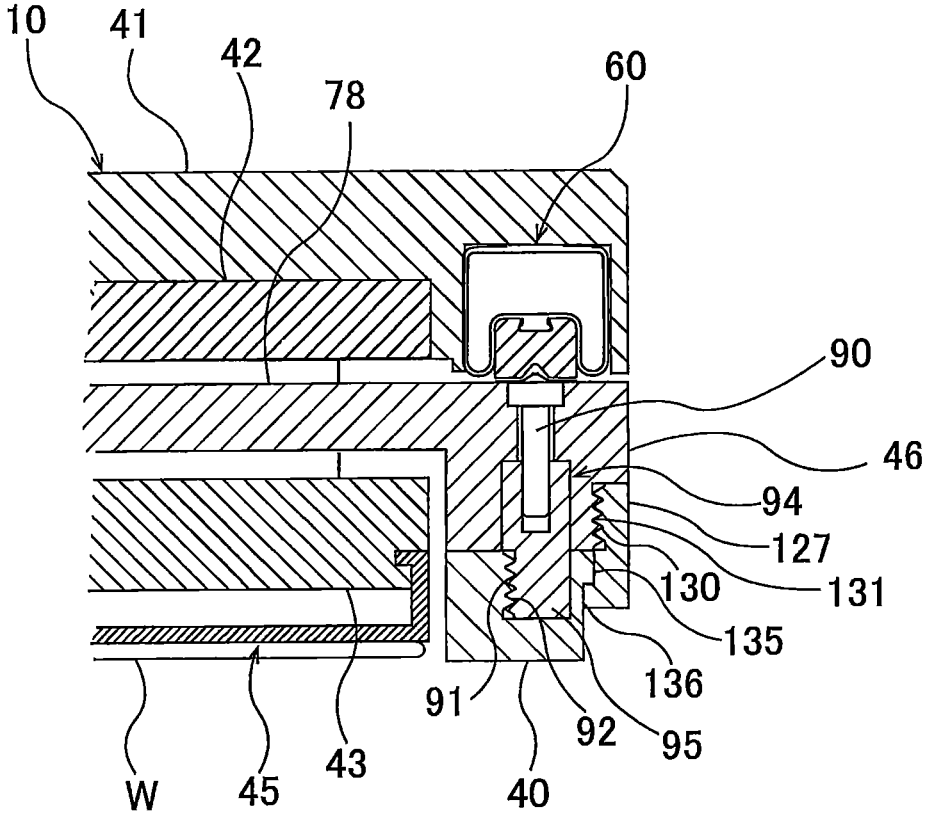
FIG. 20 is a view showing an embodiment including a locking structure which is constituted by a lock ring.

The locking structure shown in FIG. 20 comprises a lock ring 127 which presses the retainer ring 40 against the drive ring 46. A male thread 130 is formed on the outer circumferential surface of the drive ring 46. A female thread 131, which engages the male thread 130 of the drive ring 46, is formed on an inner circumferential surface of the lock ring 127. The retainer ring 40 has, at its upper portion, a flange portion 135 which protrudes outwardly. The lock ring 127 has, at its lower portion, a small-diameter portion 136 which protrudes inwardly. The lock ring 127 is fastened to the drive ring 46 until an upper surface of the small-diameter portion 136 of the lock ring 127 is brought into contact with a lower surface of the flange portion 135 of the retainer ring 40. The retainer ring 40 is pressed against the drive ring 46 by the lock ring 127, which can thus prevent the first screw thread 91 and the second screw thread 92 from being loosened.

A direction in which the lock ring 127 is tightened is preferably opposite to a direction in which the second screw thread 92 of the retainer ring 40 is tightened. This is advantageous for preventing the looseness of the retainer ring 40 because, when the retainer ring 40 rotates in a direction to loosen the second screw thread 92, the lock ring 127 is tightened. The lock ring 127 can be applied to the embodiment shown in FIG. 14 and FIG. 15 as well.

Figure 21:
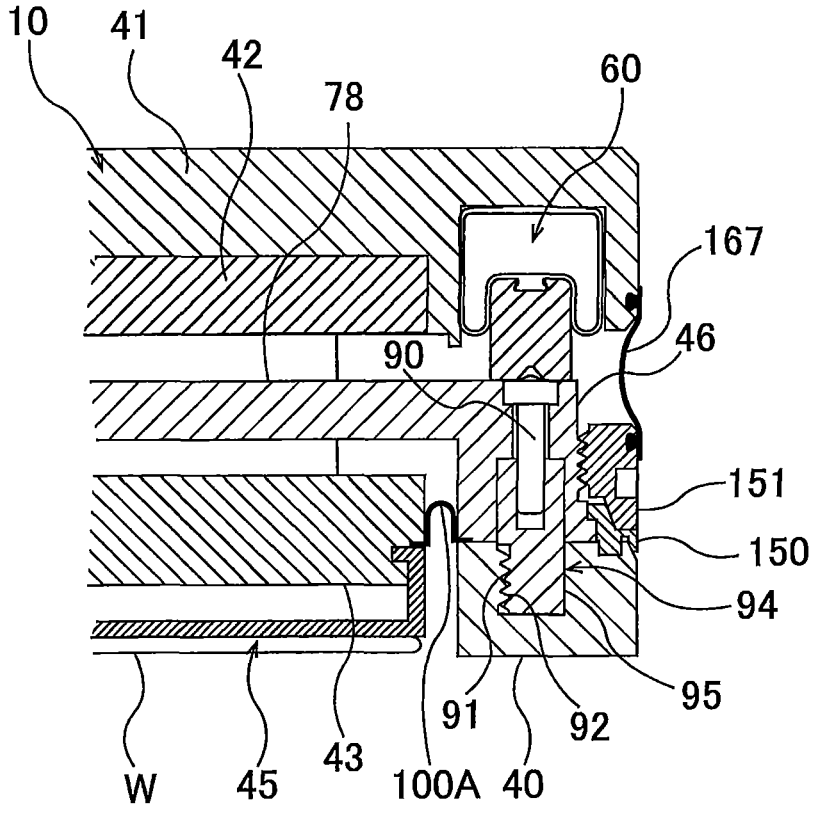
FIG. 21 is a view showing still another embodiment of the locking structure.
Figure 22:
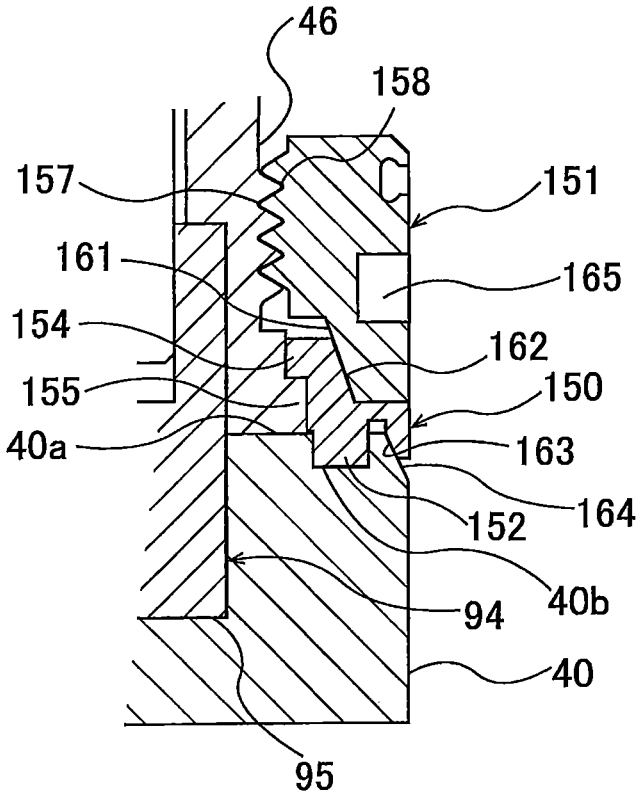
FIG. 22 is an enlarged view of a lock ring and a lock nut shown in FIG. 21.

FIG. 21 is a view showing still another embodiment of the locking structure. The locking structure shown in FIG. 21 is basically constituted by a combination of a lock ring 150 and a lock nut 151. FIG. 22 is an enlarged view of the lock ring 150 and the lock nut 151 shown in FIG. 21. The lock ring 150 has a plurality of projecting portions 152 which protrude downwardly. A plurality of holes 40*b*, into which the projecting portions 152 are fitted respectively, are formed in the upper surface 40*a* of the retainer ring 40. The lock ring 150 is in contact with the outer circumferential surface of the drive ring 46, with the projecting portions 152 being fitted into the holes 40*b* of the retainer ring 40, respectively.

The lock ring 150 is disposed around the drive ring 46. The lock ring 150 has a small-diameter portion 154 which protrudes radially inwardly. The drive ring 46 has a flange portion 155 which protrudes radially outwardly. A lower surface of the small-diameter portion 154 is in contact with an upper surface of the flange portion 155, so that the small-diameter portion 154 of the lock ring 150 engages with the flange portion 155 of the drive ring 46.

The lock nut 151 is disposed around the drive ring 46, and is in contact with the lock ring 150. A female thread 157 is formed on an inner circumferential surface of the lock nut 151, and a male thread 158 is formed on the outer circumferential surface of the drive ring 46. The female thread 157 extends helically in a circumferential direction of the lock nut 151, and the male thread 158 extends helically in a circumferential direction of the drive ring 46.

At least a part of a lower surface of the lock nut 151 is constituted by a tapered surface 161, and at least a part of an upper surface of the lock ring 150 is constituted by a tapered surface 162 which is in contact with the tapered surface 161 of the lock nut 151. The tapered surface 161 and the tapered surface 162 have truncated cone shapes, respectively, which have the same slope angle. The tapered surface 161 of the lock nut 151 is in contact with the tapered surface 162 of the lock ring 150, and the female thread 157 of the lock nut 151 is screwed onto the male thread 158 of the drive ring 46. Since the small-diameter portion 154 of the lock ring 150 engages with the flange portion 155 of the drive ring 46, the lock ring 150 is supported by the drive ring 46. Therefore, even if the lock nut 151 is tightened strongly, the lock ring 150 does not transmit a downward force to the retainer ring 40.

An outer circumferential portion of the lower surface of the lock ring 150 is constituted by a tapered surface 163, and an outer circumferential portion of the upper surface 40*a* of the retainer ring 40 is constituted by a tapered surface 164 which is in contact with the tapered surface 163 of the lock ring 150. The tapered surface 163 and the tapered surface 164 have truncated cone shapes, respectively, which have the same slope angle. When the lock nut 151 is tightened, the tapered surface 163 of the lock ring 150 is pressed against the tapered surface 164 of the retainer ring 40, so that a gap between the lock ring 150 and the retainer ring 40 is sealed.

Figure 23:
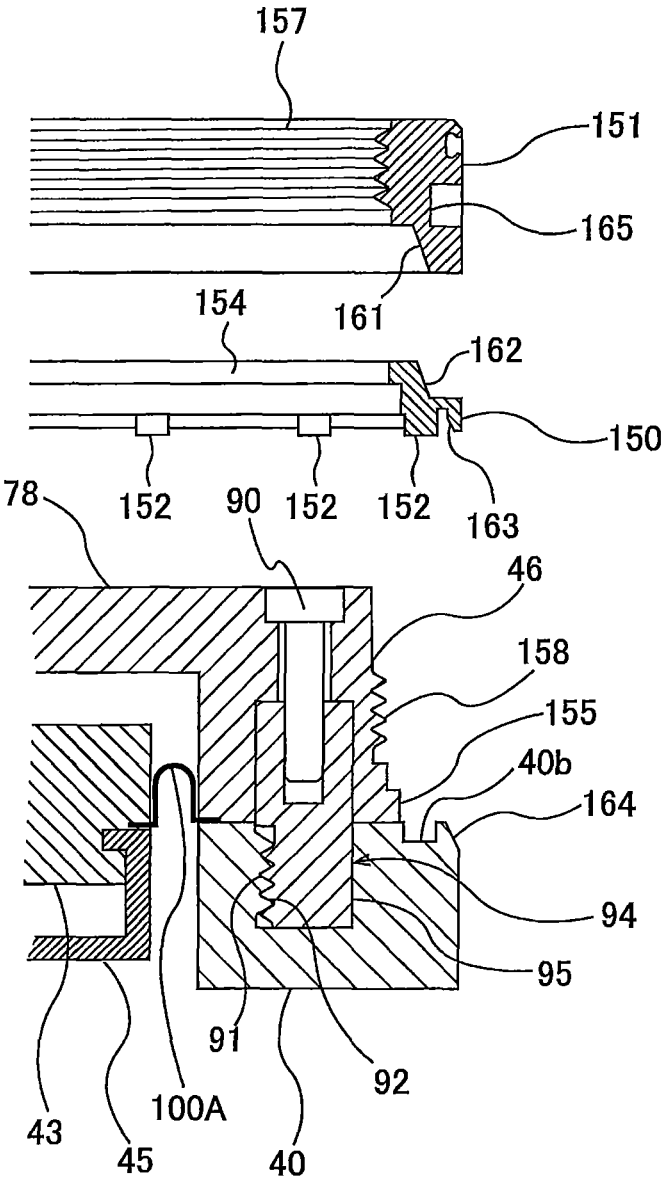
FIG. 23 is an exploded view of the lock ring and the lock nut.

FIG. 23 is an exploded view of the lock ring 150 and the lock nut 151. The lock ring 150 is mounted on the outer circumferential surface of the drive ring 46, with the projecting portions 152 being fitted into the holes 40*b* of the retainer ring 40 and with the small-diameter portion 154 engaging with the flange portion 155. Further, the lock nut 151 is rotated to screw the female thread 157 of the lock nut 151 onto the male thread 158 of the drive ring 46. By tightening the lock nut 151, the tapered surface 161 of the lock nut 151 is pressed against the tapered surface 162 of the lock ring 150, whereby the lock ring 150 is sandwiched between the lock nut 151 and the drive ring 46. Since the projecting portions 152 of the lock ring 150 are fitted in the holes 40*b* of the retainer ring 40, the rotation of the retainer ring 40 is restrained by the lock ring 150.

A recess 165, into which the projection 112 (see FIG. 16) of the tightening tool 110 can be inserted, is formed in an outer circumferential surface of the lock nut 151. Therefore, as with the retainer ring 40, the lock nut 151 can be tightened with use of the tightening tool 110. A tightening tool, which is different from the tightening tool 110, may be prepared for the lock nut 151. When the lock nut 151 is tightened, the tapered surfaces 161, 162 of the lock ring 150 and the lock nut 151 exert a wedge effect, so that the lock ring 150 is secured to the drive ring 46. The rotation of the retainer ring 40 is prevented by the lock ring 150.

A direction in which the lock nut 151 is tightened is preferably opposite to the direction in which the second screw thread 92 of the retainer ring 40 is tightened. This configuration is advantageous for preventing the looseness of the retainer ring 40, because the lock nut 151 is tightened when the retainer ring 40 rotates in the direction to loosen the second screw thread 92.

As shown in FIG. 21, in order to prevent the polishing liquid or water from entering through a gap between the head body 10 and the lock nut 151, a seal band 167 is provided. This seal band 167 connects the outer circumferential surface of the head body 10 to the outer circumferential surface of the lock nut 151. The seal band 167 is formed by a flexible annular sheet, and extends over entire circumferences of the head body 10 and the lock nut 151. The seal band 167 can expand and contract in the vertical direction and does not obstruct the vertical movement of the retainer ring 40.

In the embodiment shown in FIG. 21, a seal ring 100A, having an inverted U-shaped cross section, is provided, which connects the elastic membrane (or the membrane) 45 to the retainer ring 40. An inner circumferential edge of the seal ring 100A is connected to the elastic membrane 45, and an outer circumferential edge of the seal ring 100A is connected to the retainer ring 40. The inverted U-shaped seal ring 100A has a shape that prevents the slurry from entering the gap between the elastic membrane (membrane) 45 and the retainer ring 40, and does not obstruct the vertical movement of the retainer ring 40. The seal ring 100A may be integral with the elastic membrane 45.

Figure 24:
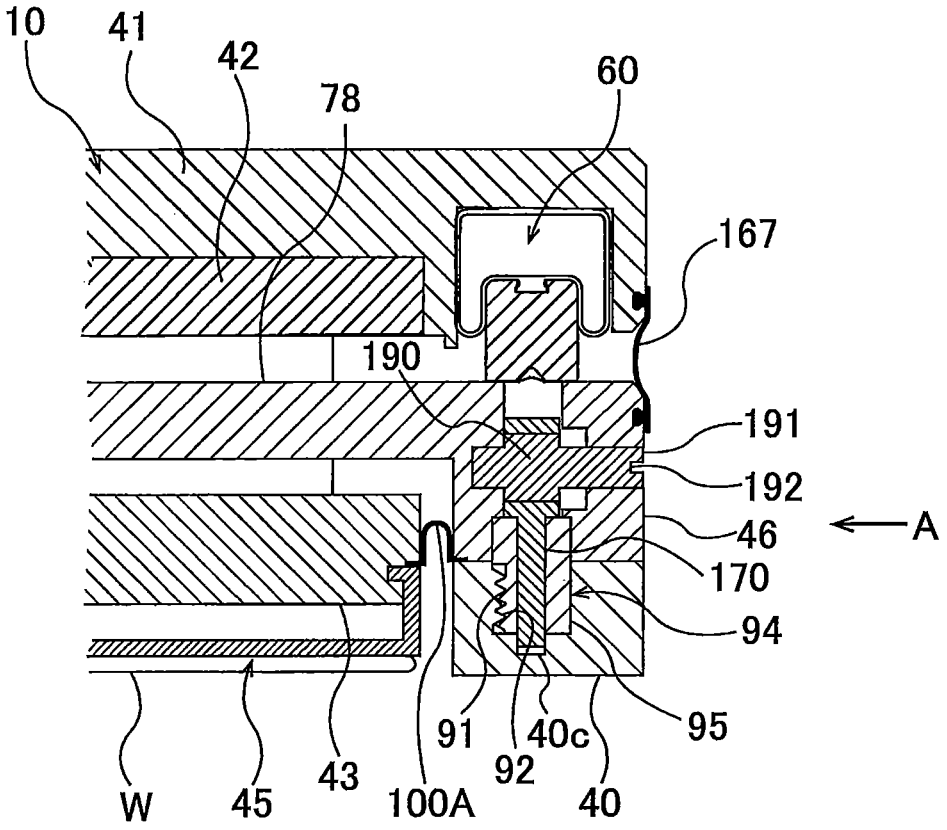
FIG. 24 is a view showing still another embodiment of the locking structure.

FIG. 24 is a view showing still another embodiment of the locking structure. The locking structure shown in FIG. 24 includes a pin 170 which is supported by the drive ring 46 so as to be able to move up and down, and a camshaft 190 which engages with the pin 170. The pin 170 can move in the vertical direction relative to the drive ring 46 and the retainer ring 40. The retainer ring 40 has a hole 40*c* formed therein. When a distal end of the pin 170 is inserted into the hole 40*c*, the rotation of the retainer ring 40 relative to the drive ring 46 is restrained. In this embodiment, the pin 170 extends vertically through the drive ring 46, and a lateral movement of the pin 170 is restrained by the drive ring 46.

The camshaft 190 is rotatably supported by the drive ring 46. The camshaft 190 has an exposed end 191. This exposed end 191 lies in the outer circumferential surface of the drive ring 46. A groove 192, with which a tip end of a slotted screwdriver can engage, is formed in this exposed end 191. When the slotted screwdriver is rotated with its tip end in engagement with the groove 192, the camshaft 190 can be rotated about its own axis.

Figure 25:
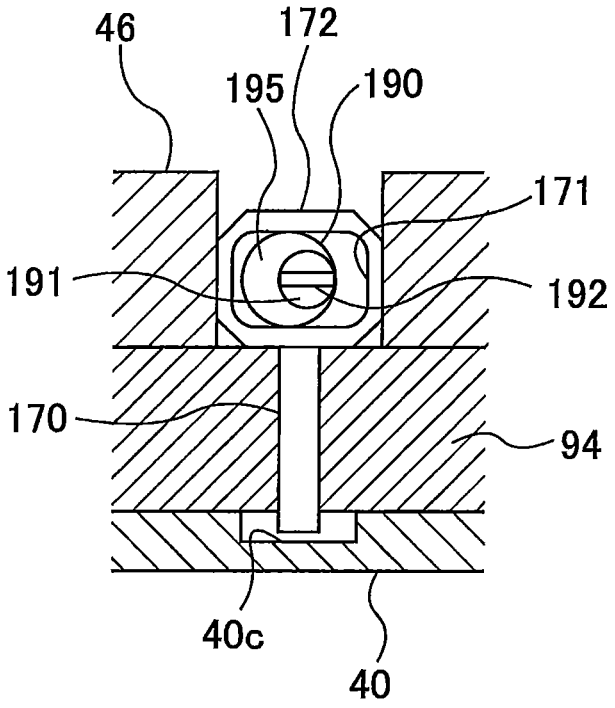
FIG. 25 is a cross-sectional view showing the locking structure as viewed from a direction indicated by arrow A shown in FIG. 24.
Figure 26:
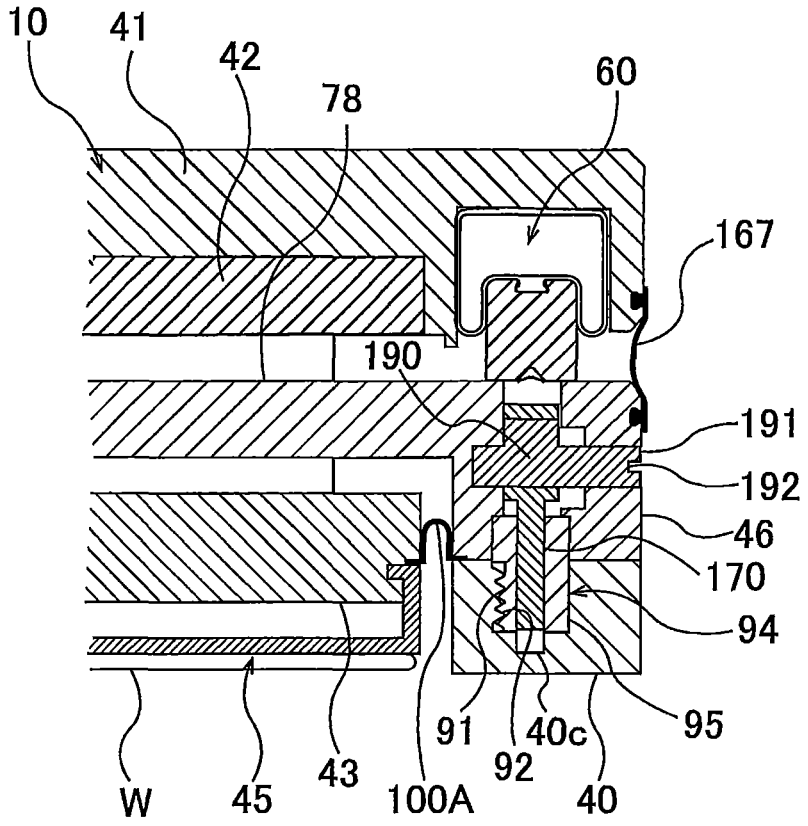
FIG. 26 is a view showing a state in which a pin is raised until the pin comes out of a hole of the retainer ring.
Figure 27:
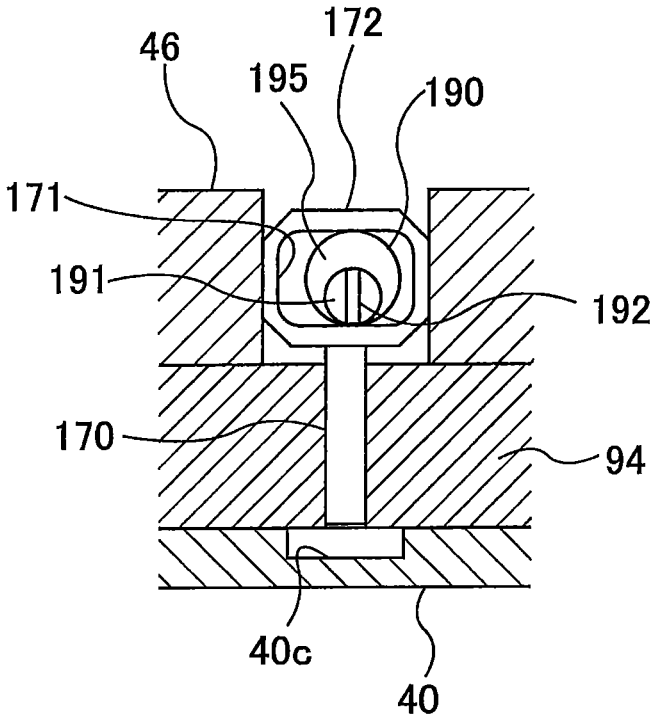
FIG. 27 is a view showing a state in which the pin is raised until the pin comes out of the hole of the retainer ring.

FIG. 25 is a cross-sectional view showing the locking structure as viewed from a direction indicated by arrow A shown in FIG. 24. The camshaft 190 has a cam portion 195 which is eccentric with respect to the axis of the camshaft 190. An upper portion of the pin 170 is constituted by a block 172 having a rectangular hole 171 formed therein. The camshaft 190 passes through the hole 171 of the block 172, and the cam portion 195 of the camshaft 190 is in contact with an inner surface, defining the hole 171, of the block 172. When the camshaft 190 is rotated about its own axis, the cam portion 195 causes the pin 170 to move up and down. FIG. 24 and FIG. 25 illustrate a state in which the pin 170 is inserted into the hole 40*c*, and FIG. 26 and FIG. 27 illustrate a state in which the pin 170 is elevated out of the hole 40*c*.

Figure 28:
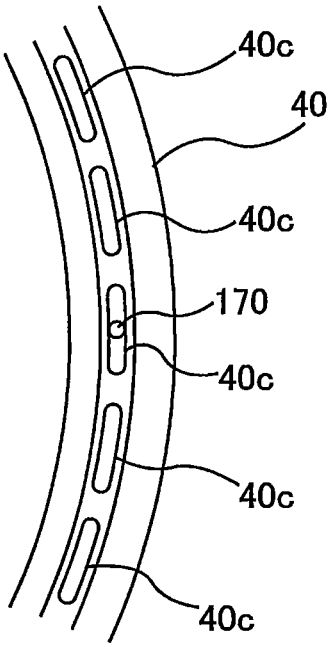
FIG. 28 is a plan view showing an embodiment of holes of the retainer ring.

A rotation in a direction to loosen or tighten the retainer ring 40 during polishing is restrained by the engagement of the pin 170 and the hole 40*c*. As shown in FIG. 28, in view of a working operation, each of holes 40*c* of the retainer ring 40 may preferably be in a shape of elongated hole extending in the circumferential direction. When the retainer ring 40 is tightened at a fixed torque, it is impossible to know a position at which the retainer ring 40 comes to a stop. If each hole 40*c* of the retainer ring 40 has a circular shape, it is difficult to align the pin 170 with the circular hole. According to this embodiment, there may be an advantage that a positioning adjustment can be omitted, because each of holes 40*c* is the elongated hole extending in the circumferential direction of the retainer ring 40. Specifically, if the pin 170 is located above the hole 40*c* after the retainer ring 40 is tightened at a predetermined torque, the camshaft 190 can be rotated to lower the pin 170. On the other hand, if the pin 170 is not located above the hole 40*c*, the retainer ring 40 is further tightened until the pin 170 is located above the hole 40*c*. Even when the distal end of the pin 170 is in the hole 40*c*, the retainer ring 40 can be rotated within a length of the hole 40*c*. Therefore, the hole 40*c* may preferably have a length (i.e., a length in the circumferential direction of the retainer ring 40) that does not affect the process even if the tightening torque changes.

Whether the pin 170 is located right above the hole 40*c* when the retainer ring 40 has been tightened can be judged from positions of marks (not shown) which are provided on the outer circumferential surface of the retainer ring 40 and the outer circumferential surface of the drive ring 46, respectively. The mark provided on the retainer ring 40 indicates the position of the hole 40*c*, while the mark provided on the drive ring 46 indicates the position of the pin 170.

Figure 29:
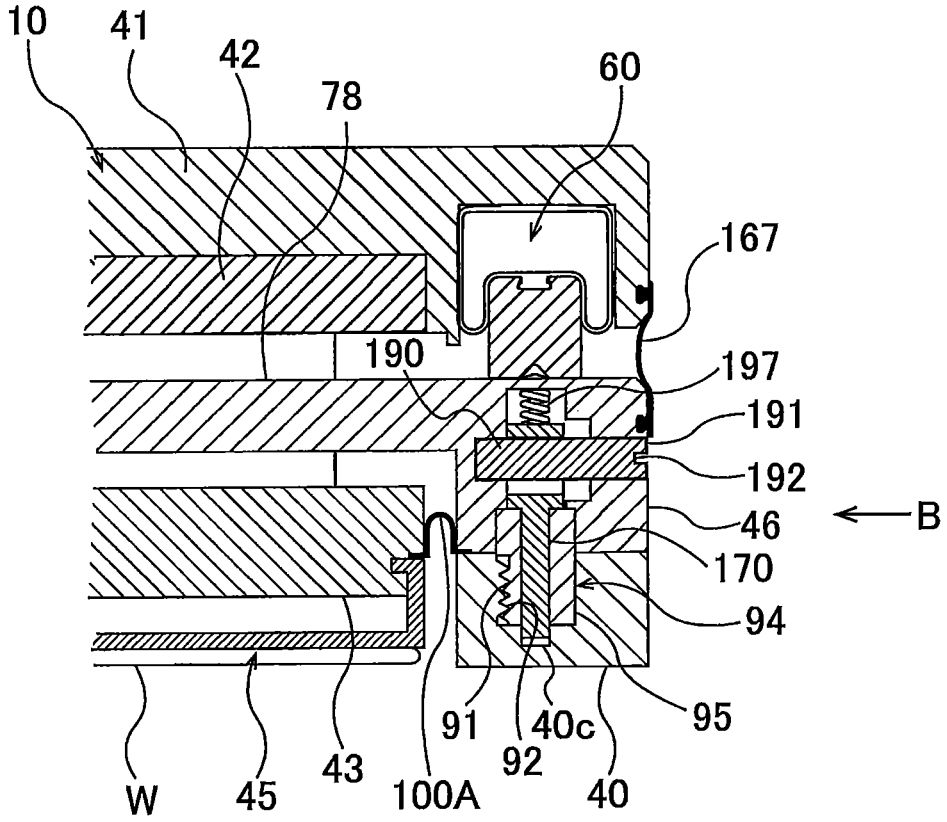
FIG. 29 is a view showing still another embodiment of the locking structure.
Figure 30:
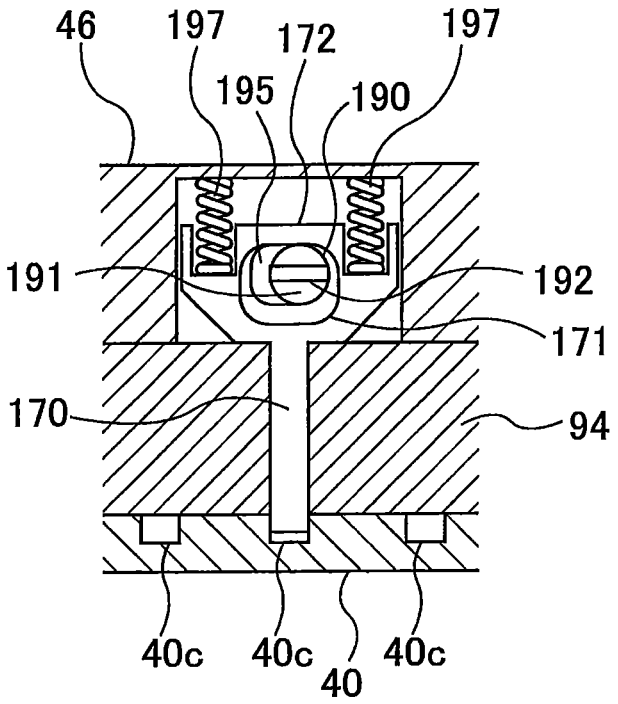
FIG. 30 is a cross-sectional view showing the locking structure as viewed from a direction indicated by arrow B shown in FIG. 29.

FIG. 29 is a view showing still another embodiment of the locking structure. FIG. 30 is a cross-sectional view showing the locking structure as viewed from a direction indicated by arrow B shown in FIG. 29. The locking structure shown in FIG. 29 and FIG. 30 includes pin 170 which is supported by the drive ring 46 so as to be able to move up and down, camshaft 190 which engages with the pin 170, and springs 197 which push the pin 170 toward the retainer ring 40. While two springs 197 are provided in this embodiment, one spring or three or more springs may be provided. Basic structures in this embodiment are identical to those of the embodiment shown in FIG. 24 and FIG. 25, and repetitive descriptions thereof are omitted.

Figure 31:
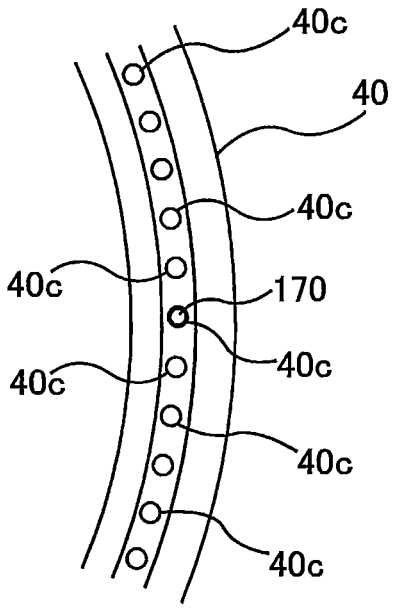
FIG. 31 is a plan view showing holes formed in the retainer ring.
Figure 32:
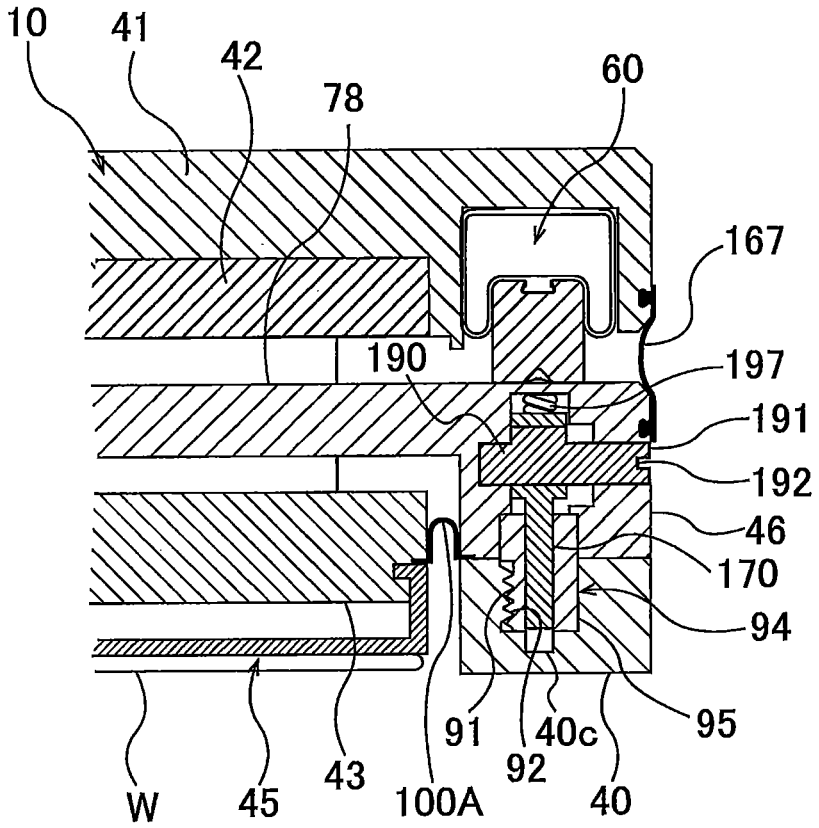
FIG. 32 is a view showing a state in which a camshaft is rotated to raise the pin with a cam portion.
Figure 33:
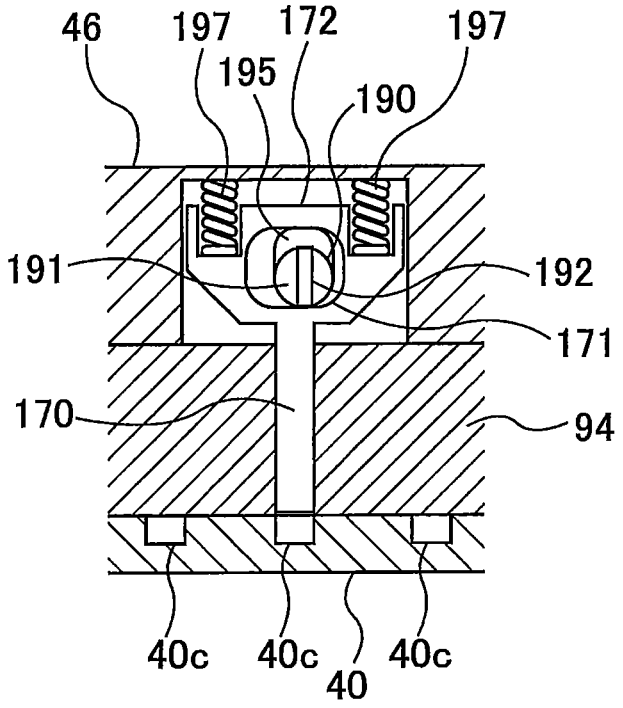
FIG. 33 is a view showing a state in which the camshaft is rotated to raise the pin with the cam portion.
Figure 34:
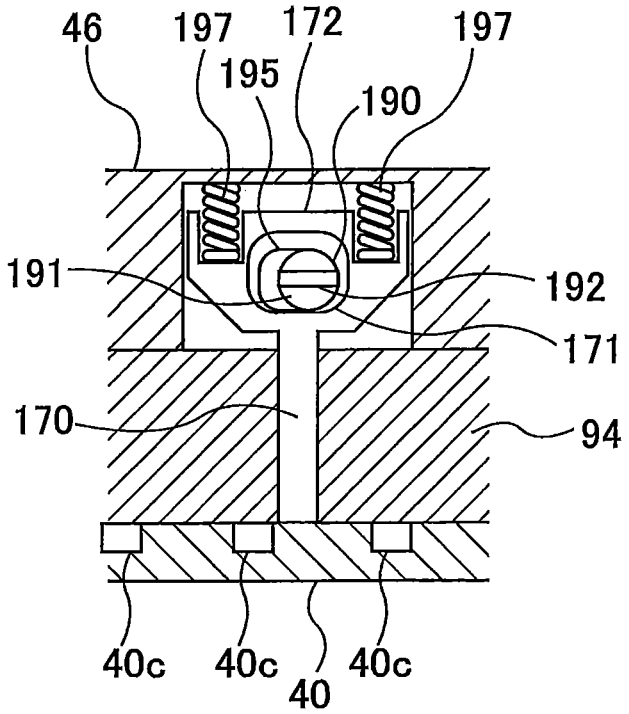
FIG. 34 is a view showing a state in which the pin is not aligned with the hole of the retainer ring.

FIG. 31 is a plan view showing holes 40*c* formed in the retainer ring 40. In this embodiment, each of holes 40*c* is a circular hole. FIG. 32 and FIG. 33 are views each showing a state in which the camshaft 190 is rotated until the cam portion 195 elevates the pin 170. As shown in FIG. 32 and FIG. 33, before the retainer ring 40 is tightened, the pin 170 is elevated by the camshaft 190. After the retainer ring 40 is tightened, the camshaft 190 is rotated, thereby allowing the springs 197 to press the pin 170 against the retainer ring 40. Even if the pin 170 is not aligned with the hole 40*c* as shown in FIG. 34, a rotating force is exerted on the retainer ring 40 during polishing to rotate the retainer ring 40 relative to the drive ring 46 until the pin 170 is aligned with the hole 40*c* and is then inserted into the hole 40*c* by the springs 197. In this embodiment, the camshaft 190 serves to only lift the pin 170 upwardly. The pin 170 is moved downwardly by the springs 197.

Figure 35:
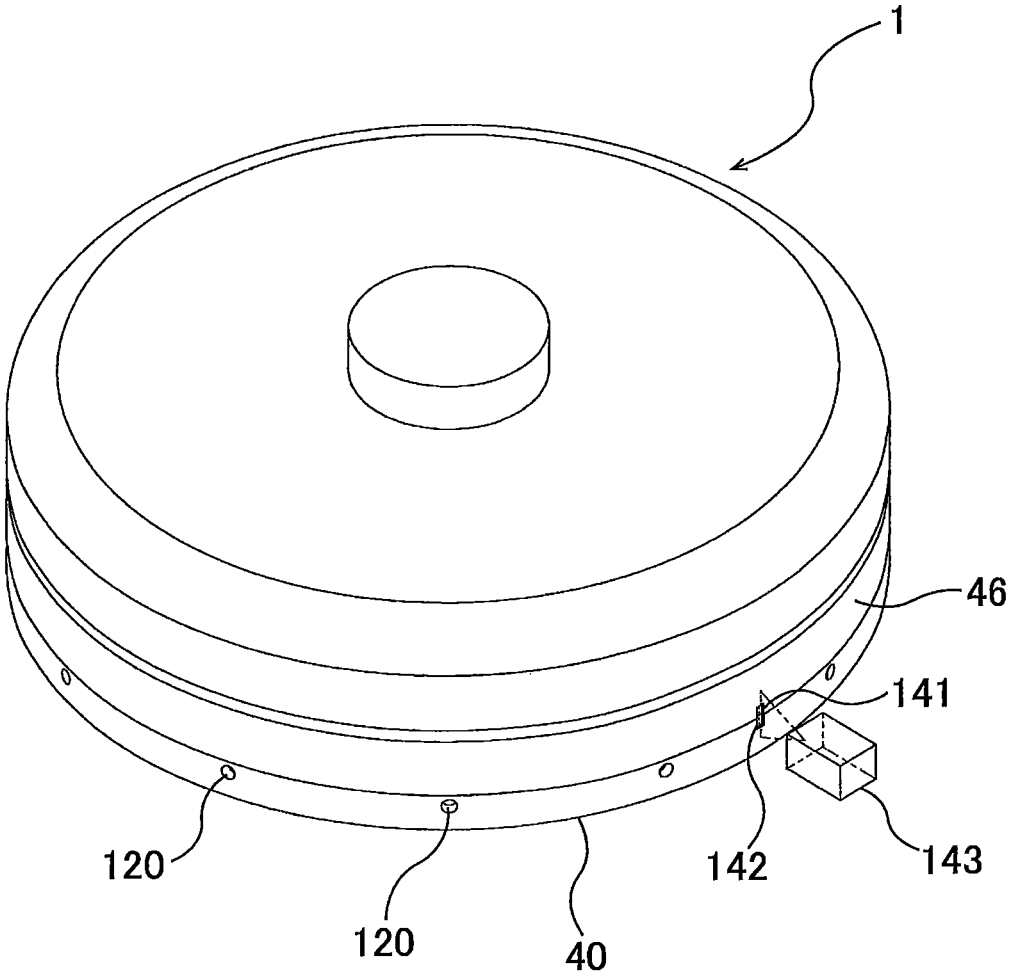
FIG. 35 is a view showing a looseness detector for detecting a looseness of the second screw thread relative to the first screw thread.

As shown in FIG. 35, a looseness detector for detecting a looseness of the second screw thread 92 relative to the first screw thread 91 may be provided. The looseness detector shown in FIG. 35 is a mark detector 143 that detects a relative position of a first mark 141 formed on the outer circumferential surface of the drive ring 46 and a second mark 142 formed on the outer circumferential surface of the retainer ring 40. The mark detector 143 may be a sensor, such as an image sensor or a laser sensor, which can measure a shape or a relative position.

Figure 36:
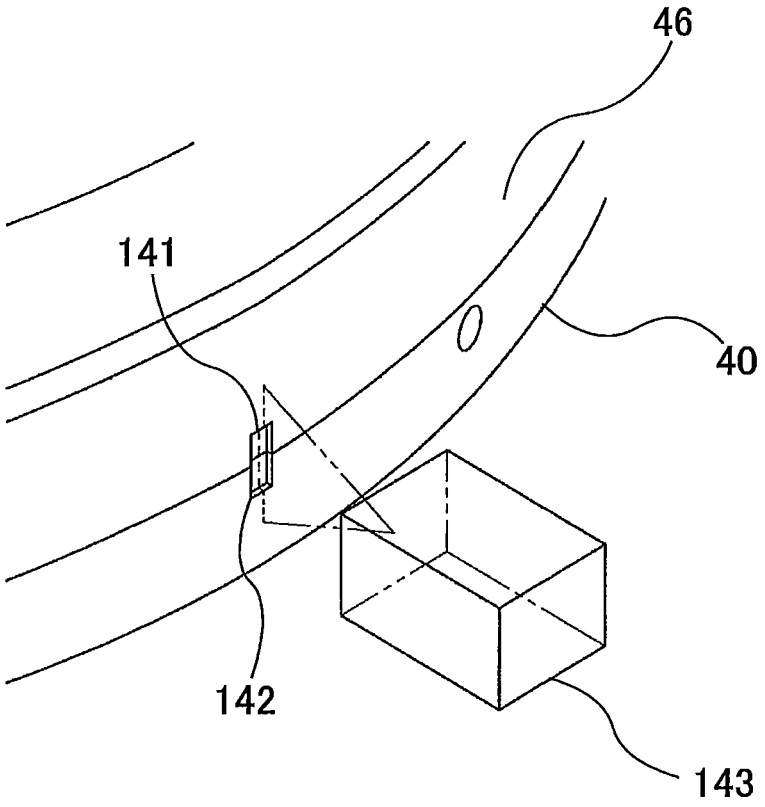
FIG. 36 is an enlarged view showing a first mark and a second mark when the second screw thread of the retainer ring is not loosened.
Figure 37:
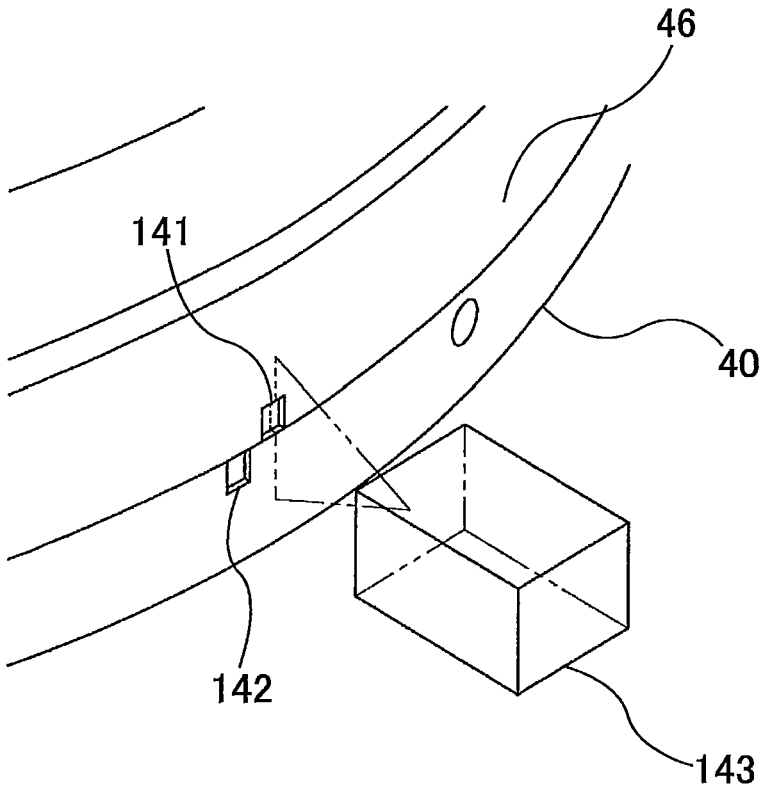
FIG. 37 is an enlarged view showing the first mark and the second mark when the second screw thread of the retainer ring is loosened.

FIG. 36 is an enlarged view showing the first mark 141 and the second mark 142 when the second screw thread 92 of the retainer ring 40 is not loosened. As shown in FIG. 36, when the second screw thread 92 of the retainer ring 40 is not loosened, the first mark 141 and the second mark 142 are at the same position. In contrast, if the second screw thread 92 of the retainer ring 40 is loosened, a position of the second mark 142 relative to the first mark 141 is displaced as shown in FIG. 37. The mark detector 143 detects the looseness of the second screw thread 92 based on the relative position of the first mark 141 and the second mark 142.

Figure 38:
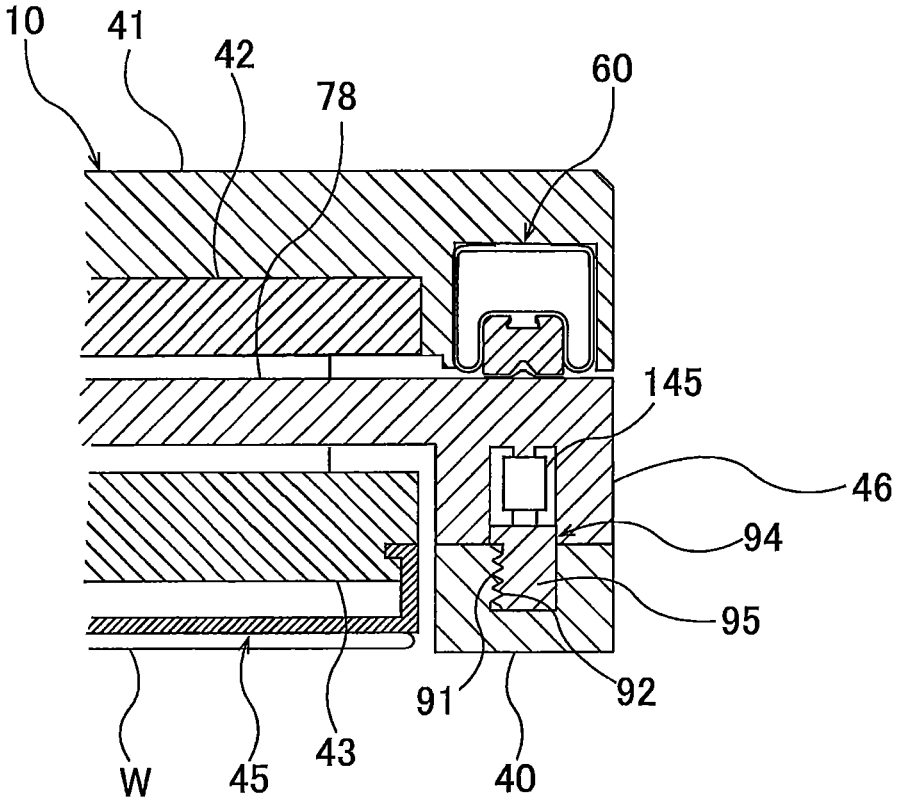
FIG. 38 is a view showing an embodiment in which a load cell is used as the looseness detector.
Figure 39:
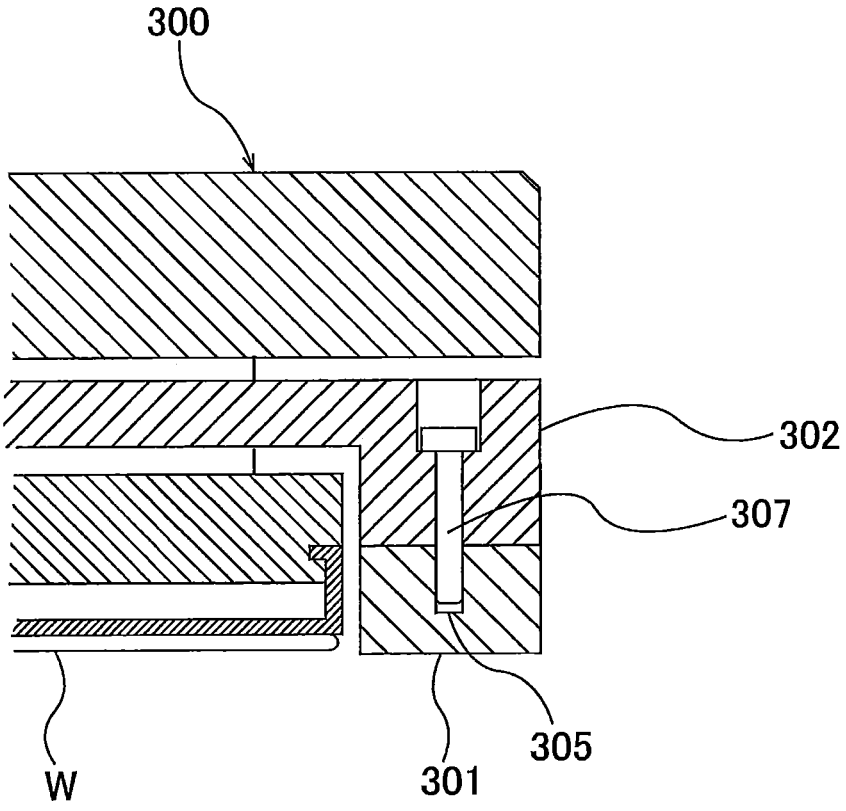
FIG. 39 is a schematic cross-sectional view of a conventional polishing head.

FIG. 38 is a view showing an embodiment in which a load cell 145 is used as the looseness detector. The load cell 145 is disposed between the drive ring 46 and the screw ring 94, and is disposed between two adjacent mounting screws 90 (see FIG. 4). When the second screw thread 92 is screwed onto the first screw thread 91, the screw ring 94 is pulled by the retainer ring 40. The load cell 145 measures this pulling force. When the second screw thread 92 is loosened, the pulling force measured by the load cell 145 is reduced. Therefore, the looseness of the second screw thread 92 can be detected from the decrease in the pulling force.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:
a polishing table for supporting a polishing pad;
a polishing head for pressing a substrate against the polishing pad; and
a head motor for rotating the polishing head,
wherein the polishing head includes:
a head body having a substrate contact surface;
a drive ring coupled to the head body; and
a retainer ring surrounding the substrate contact surface and coupled to the drive ring,
a first screw thread is formed on the drive ring,
a second screw thread, which engages with the first screw thread, is formed on the retainer ring, and
the second screw thread extends in a circumferential direction of the retainer ring; and wherein:
the drive ring includes an annular drive ring body and an annular protrusion which protrudes downwardly from a lower surface of the annular drive ring body;
an annular recess, which houses the annular protrusion therein, is formed in an upper surface of the retainer ring; and
the first screw thread is formed on a side surface of the annular protrusion, and the second screw thread is formed on a side surface of the annular recess.

2. The polishing apparatus according to claim 1, wherein the annular protrusion is constituted by at least a part of a screw ring secured to the annular drive ring body.

3. The polishing apparatus according to claim 1, wherein a lower surface of the annular drive ring body is in contact with the upper surface of the retainer ring.

4. The polishing apparatus according to claim 1, wherein:
the retainer ring includes an annular retainer ring body and a recess ring, the annular recess and the second screw thread being formed in the recess ring; and
the recess ring has a higher strength than the annular retainer ring body.

5. A polishing apparatus, comprising:
a polishing table for supporting a polishing pad;
a polishing head for pressing a substrate against the polishing pad; and
a head motor for rotating the polishing head,
wherein the polishing head includes:
a head body having a substrate contact surface;
a drive ring coupled to the head body; and
a retainer ring surrounding the substrate contact surface and coupled to the drive ring,
a first screw thread is formed on the drive ring,
a second screw thread, which engages with the first screw thread, is formed on the retainer ring, and
the second screw thread extends in a circumferential direction of the retainer ring; and wherein:
the retainer ring includes an annular retainer ring body and an annular protrusion which protrudes upwardly from an upper surface of the annular retainer ring body;
an annular recess, which houses the annular protrusion therein, is formed in a lower surface of the drive ring; and
the first screw thread is formed on a side surface of the annular recess, and the second screw thread is formed on a side surface of the annular protrusion.

6. The polishing apparatus according to claim 5, wherein the annular protrusion is constituted by at least a part of a screw ring secured to the annular retainer ring body.

7. The polishing apparatus according to claim 5, wherein an upper surface of the annular retainer ring body is in contact with a lower surface of the drive ring.

8. The polishing apparatus according to claim 1, wherein seal rings, which seal a gap between the drive ring and the retainer ring, are disposed inside and outside the first screw thread and the second screw thread, respectively.

9. The polishing apparatus according to claim 1, wherein a recess, with which a tightening tool for rotating the retainer ring about its own axis can engage, is formed in an outer circumferential surface of the retainer ring.

10. The polishing apparatus according to claim 1, wherein the head motor has a lock function to lock a rotation of the polishing head.

11. The polishing apparatus according to claim 1, wherein a direction in which the second screw thread is tightened is opposite to a direction in which the polishing head is rotated by the head motor when the polishing head is polishing the substrate.

12. The polishing apparatus according to claim 1, further comprising:
a locking structure for the first screw thread and the second screw thread.

13. The polishing apparatus according to claim 12, wherein the locking structure is a lock ring which presses the retainer ring against the drive ring.

14. The polishing apparatus according to claim 12, wherein the locking structure is a lock screw which restrains the rotation of the retainer ring relative to the drive ring.

15. The polishing apparatus according to claim 12, wherein the locking structure includes a pin which is vertically movably supported by the drive ring, and the retainer ring has a hole into which a distal end of the pin can be inserted.

16. The polishing apparatus according to claim 15, wherein the locking structure further includes a camshaft which is rotatably supported by the drive ring, and the camshaft has a cam portion and an exposed end, the cam portion being in engagement with the pin.

17. The polishing apparatus according to claim 1, further comprising:

a looseness detector for detecting a looseness of the second screw thread relative to the first screw thread.

18. The polishing apparatus according to claim 17, wherein the looseness detector is a mark detector which detects a relative position of a first mark formed on the drive ring and a second mark formed on the retainer ring.

19. The polishing apparatus according to claim 17, wherein the looseness detector is a load cell which is sandwiched between the drive ring and the retainer ring.

20. A polishing head, comprising:

a head body having a substrate contact surface;

a drive ring coupled to the head body; and a retainer ring surrounding the substrate contact surface and coupled to the drive ring, wherein a first screw thread is formed on the drive ring, a second screw thread, which engages with the first screw thread, is formed on the retainer ring, and the second screw thread extends in a circumferential direction of the retainer ring; and wherein:

the drive ring includes an annular drive ring body and an annular protrusion which protrudes downwardly from a lower surface of the annular drive ring body;

an annular recess, which houses the annular protrusion therein, is formed in an upper surface of the retainer ring; and the first screw thread is formed on a side surface of the annular protrusion, and the second screw thread is formed on a side surface of the annular recess.

21. The polishing head according to claim 20, wherein the annular protrusion is constituted by at least a part of a screw ring secured to the annular drive ring body.

22. The polishing head according to claim 20, wherein a lower surface of the annular drive ring body is in contact with an upper surface of the retainer ring.

23. The polishing head according to claim 20, wherein:

the retainer ring includes an annular retainer ring body and a recess ring, the annular recess and the second screw thread being formed in the recess ring; and the recess ring has a higher strength than the annular retainer ring body.

24. A polishing head, comprising:

a head body having a substrate contact surface;

a drive ring coupled to the head body; and a retainer ring surrounding the substrate contact surface and coupled to the drive ring, wherein a first screw thread is formed on the drive ring, a second screw thread, which engages with the first screw thread, is formed on the retainer ring, and the second screw thread extends in a circumferential direction of the retainer ring; and wherein:

the retainer ring includes an annular retainer ring body and an annular protrusion which protrudes upwardly from an upper surface of the annular retainer ring body;

an annular recess, which houses the annular protrusion therein, is formed in a lower surface of the drive ring; and the first screw thread is formed on a side surface of the annular recess, and the second screw thread is formed on a side surface of the annular protrusion.

25. The polishing head according to claim 24, wherein the annular protrusion is constituted by at least a part of a screw ring secured to the annular retainer ring body.

26. The polishing head according to claim 24, wherein an upper surface of the annular retainer ring body is in contact with a lower surface of the drive ring.

27. The polishing head according to claim 24, wherein seal rings, which seal a gap between the drive ring and the retainer ring, are disposed inside and outside the first screw thread and the second screw thread, respectively.

28. A retainer ring for use in a polishing head which includes a head body having a substrate contact surface and a drive ring coupled to the head body, the retainer ring comprising:

a second screw thread which can engage with a first screw thread formed on the drive ring, the second screw thread extending in a circumferential direction of the retainer ring, wherein an annular recess is formed in an upper surface of the retainer ring, and the second screw thread is formed on a side surface of the annular recess.

29. The retainer ring for use in a polishing head which includes a head body having a substrate contact surface and a drive ring coupled to the head body, the retainer ring comprising:

a second screw thread which can engage with a first screw thread formed on the drive ring, the second screw thread extending in a circumferential direction of the retainer ring;

an annular retainer ring body; and an annular protrusion which protrudes upwardly from an upper surface of the annular retainer ring body, the second screw thread being formed on a side surface of the annular protrusion.

* * * * *